US007493967B2

(12) United States Patent
Mock et al.

(10) Patent No.: US 7,493,967 B2
(45) Date of Patent: Feb. 24, 2009

(54) TRACTOR WITH IMPROVED VALVE SYSTEM

(75) Inventors: Philip W Mock, Newport Beach, CA (US); Rudolph Ernst Krueger, V, Costa Mesa, CA (US); Duane Bloom, Anaheim, CA (US); Norman Bruce Moore, Aliso Viejo, CA (US)

(73) Assignee: Western Well Tool, Inc., Anaheim, CA (US)

( * ) Notice: Subject to any disclaimer, the term of this patent is extended or adjusted under 35 U.S.C. 154(b) by 0 days.

(21) Appl. No.: 12/044,502

(22) Filed: Mar. 7, 2008

(65) Prior Publication Data

US 2008/0223616 A1 Sep. 18, 2008

Related U.S. Application Data

(63) Continuation of application No. 11/417,535, filed on May 3, 2006, now Pat. No. 7,343,982, which is a continuation of application No. 10/745,400, filed on Dec. 23, 2003, now Pat. No. 7,121,364.

(60) Provisional application No. 60/525,309, filed on Nov. 26, 2003, provisional application No. 60/448,163, filed on Feb. 14, 2003, provisional application No. 60/446,644, filed on Feb. 10, 2003.

(51) Int. Cl.
*E21B 4/18* (2006.01)
*E21B 4/00* (2006.01)

(52) U.S. Cl. ..... 175/57; 175/51; 175/76; 175/99

(58) Field of Classification Search ..... 175/97–99, 175/51, 57, 76; 166/373; 299/31
See application file for complete search history.

(56) References Cited

U.S. PATENT DOCUMENTS 2,167,194 A 7/1939 Anderson (Continued)

FOREIGN PATENT DOCUMENTS

EP 0 257 744 B1 1/1995

(Continued)

OTHER PUBLICATIONS

"Kolibomac to Challenge Tradition." Norwegian Oil Review, 1988. pp. 50 & 52.

*Primary Examiner*—Shane Bomar
(74) *Attorney, Agent, or Firm*—Knobbe, Martens, Olson & Bear LLP

(57) ABSTRACT

A hydraulically powered tractor adapted for advancement through a borehole including an elongate body, aft and forward gripper assemblies, and a valve control assembly housed within the elongate body. The aft and forward gripper assemblies are adapted for selective engagement with the inner surface of the borehole. The valve control assembly includes a gripper control valve for directing pressurized fluid to the aft and forward gripper assemblies. The valve control assembly also includes a propulsion control valve for directing fluid to an aft or forward power chamber for advancing the body relative to the actuated gripper assembly. Aft and forward mechanically actuated valves may be provided for controlling the position of the gripper control valve by detecting and signaling when the body has completed an advancement stroke relative to an actuated gripper assembly. Aft and forward sequence valves may be provided for controlling the propulsion control valve by detecting when the gripper assemblies become fully actuated. Furthermore, a pressure relief valve is preferably provided along an input supply line for limiting the pressure of the fluid entering the valve control assembly.

12 Claims, 19 Drawing Sheets

U.S. PATENT DOCUMENTS

| | | | |
|---|---|---|---|
| 2,271,005 | A | 1/1942 | Grebe |
| 2,946,565 | A | 7/1960 | Williams |
| 2,946,578 | A | 7/1960 | De Smaele |
| 3,138,214 | A | 6/1964 | Bridwell |
| 3,180,436 | A | 4/1965 | Kellner et al. |
| 3,180,437 | A | 4/1965 | Kellner et al. |
| 3,185,225 | A | 5/1965 | Ginies |
| 3,224,513 | A | 12/1965 | Weeden, Jr. |
| 3,224,734 | A | 12/1965 | Hill |
| 3,225,843 | A | 12/1965 | Ortloff et al. |
| 3,376,942 | A | 4/1968 | Van Winkle |
| 3,497,019 | A | 2/1970 | Ortloff |
| 3,599,712 | A | 8/1971 | Magill |
| 3,606,924 | A | 9/1971 | Malone |
| 3,797,589 | A | 3/1974 | Kellner et al. |
| 3,827,512 | A | 8/1974 | Edmond |
| RE28,449 | E | 6/1975 | Edmond |
| 3,941,190 | A | 3/1976 | Conover |
| 3,978,930 | A | 9/1976 | Schroeder |
| 3,992,565 | A | 11/1976 | Gatfield |
| 4,085,808 | A | 4/1978 | Kling |
| 4,095,655 | A | 6/1978 | Still |
| 4,141,414 | A | 2/1979 | Johansson |
| 4,314,615 | A | 2/1982 | Sodder, Jr. et al. |
| 4,365,676 | A | 12/1982 | Boyadjieff et al. |
| 4,372,161 | A | 2/1983 | De Buda et al. |
| 4,385,021 | A | 5/1983 | Neeley |
| 4,440,239 | A | 4/1984 | Evans |
| 4,463,814 | A | 8/1984 | Horstmeyer et al. |
| 4,558,751 | A | 12/1985 | Huffaker |
| 4,615,401 | A | 10/1986 | Garrett |
| 4,674,914 | A | 6/1987 | Wayman et al. |
| 4,686,653 | A | 8/1987 | Staron et al. |
| 4,811,785 | A | 3/1989 | Weber |
| 4,821,817 | A | 4/1989 | Cendre et al. |
| 4,854,397 | A | 8/1989 | Warren et al. |
| 4,951,760 | A | 8/1990 | Cendre et al. |
| 5,010,965 | A | 4/1991 | Schmelzer |
| 5,052,211 | A | 10/1991 | Cohrs et al. |
| 5,169,264 | A | 12/1992 | Kimura |
| 5,184,676 | A | 2/1993 | Graham et al. |
| 5,186,264 | A | 2/1993 | du Chaffaut |
| 5,310,012 | A | 5/1994 | Cendre et al. |
| 5,363,929 | A | 11/1994 | Williams et al. |
| 5,425,429 | A | 6/1995 | Thompson |
| 5,449,047 | A | 9/1995 | Schivley, Jr. |
| 5,467,832 | A | 11/1995 | Orban et al. |
| 5,519,668 | A | 5/1996 | Montaron |
| 5,542,253 | A | 8/1996 | Ganzel |
| 5,613,568 | A | 3/1997 | Sterner et al. |
| 5,752,572 | A | 5/1998 | Baiden et al. |
| 5,758,731 | A | 6/1998 | Zollinger |
| 5,758,732 | A | 6/1998 | Liw |
| 5,794,703 | A | 8/1998 | Newman et al. |
| 5,803,193 | A | 9/1998 | Krueger et al. |
| 5,845,796 | A | 12/1998 | Miller |
| 5,857,731 | A | 1/1999 | Heim et al. |
| 5,996,979 | A | 12/1999 | Hrsuch |
| 6,003,606 | A | 12/1999 | Moore et al. |
| 6,026,911 | A | 2/2000 | Angle et al. |
| 6,031,371 | A | 2/2000 | Smart |
| 6,082,461 | A | 7/2000 | Newman et al. |
| 6,089,323 | A | 7/2000 | Newman et al. |
| 6,112,809 | A | 9/2000 | Angle |
| 6,241,031 | B1 | 6/2001 | Beaufort et al. |
| 6,273,189 | B1 | 8/2001 | Gissler et al. |
| 6,347,674 | B1 | 2/2002 | Bloom et al. |
| 6,431,270 | B1 | 8/2002 | Angle |
| 6,467,557 | B1 * | 10/2002 | Krueger et al. ..... 175/45 |
| 6,478,097 | B2 | 11/2002 | Bloom et al. |
| 6,629,568 | B2 | 10/2003 | Post et al. |
| 6,679,341 | B2 | 1/2004 | Bloom et al. |
| 6,953,086 | B2 | 10/2005 | Simpson |
| 7,353,886 | B2 * | 4/2008 | Bloom et al. ..... 175/51 |
| 2002/0088648 | A1 | 7/2002 | Krueger et al. |
| 2002/0112849 | A1 | 8/2002 | Bloom et al. |
| 2003/0150609 | A1 | 8/2003 | Stoesz |
| 2005/0145415 | A1 | 7/2005 | Doering et al. |
| 2005/0217861 | A1 | 10/2005 | Misselbrook |

FOREIGN PATENT DOCUMENTS

| | | |
|---|---|---|
| WO | WO 94/27022 | 11/1994 |
| WO | WO 0046481 | 8/2000 |
| WO | WO 0244509 A2 | 6/2002 |

* cited by examiner

TRACTOR WITH IMPROVED VALVE SYSTEM

RELATED APPLICATIONS

"The present application is a continuation of U.S. application Ser. No. 11/417,535, filed May 3, 2006, now U.S. Pat. No. 7,343,982, which is a continuation U.S. patent application Ser. No. 10/745,400, filed Dec. 23, 2003, now U.S. Pat. No. 7,121,364, issued Oct. 17,2006, which claims priority to U.S. Provisional Patent Application Ser. No. 60/446,644, filed Feb. 10, 2003; U.S. Provisional Patent Application Ser. No. 60/448,163, filed Feb. 14, 2003; and U.S. Provisional Patent Application Ser. No. 60/525,309, filed Nov. 26, 2003."

INCORPORATION BY REFERENCE

This application incorporates by reference the entire disclosures of (1) U.S. Pat. No. 6,679,341; (2) U.S. Provisional Patent Application Ser. No. 60/446,644, filed on Feb. 10, 2003; and (3) U.S. Provisional Patent Application Ser. No. 60/448,163, filed on Feb. 14, 2003, and (4) U.S. application Ser. No. 10/745,400, filed Dec. 23, 2003.

BACKGROUND OF THE INVENTION

1. Field of the Invention

This invention relates generally to tractors for moving equipment within passages and, more particularly, to a hydraulically powered tractor having an improved valve system.

2. Description of the Related Art

The art of moving equipment through vertical, inclined, and horizontal passages plays an important role in many industries, such as the petroleum, mining, and communications industries. In the petroleum industry, for example, it is often necessary to move drilling, intervention, well completion, and other forms of equipment through boreholes drilled into the earth.

One method for moving equipment through a borehole is to use rotary drilling equipment. In traditional rotary drilling, vertical and inclined boreholes are commonly drilled by the attachment of a rotary drill bit and/or other equipment (collectively, the "Bottom Hole Assembly" or BHA) to the end of a rigid drill string. The drill string is typically constructed of a series of connected links of drill pipe that extend between ground surface equipment and the BHA. A passage is drilled as the drill string and drill bit are together lowered into the earth. A drilling fluid, such as drilling mud, is pumped from the ground surface equipment through an interior flow channel of the drill string to the drill bit. The drilling fluid is used to cool and lubricate the bit, as well as for removing debris and rock chips from the borehole. The drilling fluid returns to the surface, carrying the cuttings and debris, through the annular space between the outer surface of the drill pipe and the inner surface of the borehole. As the drill string is lowered or raised within the borehole, it is necessary to continually add or remove links of drill pipe at the surface, at significant time and cost.

Another method of moving equipment within a borehole involves the use of downhole tools commonly referred to as "tractors." A tractor is capable of gripping onto the borehole and thrusting both itself and other equipment through it. A self-propelled tractor of this type may be used for pushing and pulling adjoining equipment through inclined or horizontal boreholes. Tractors can be attached to rigid drill strings or may be used in conjunction with coiled tubing equipment.

Coiled tubing equipment generally includes a non-rigid, compliant tube, referred to herein simply as "coiled tubing," through which operating fluid is delivered to the tractor. The operating fluid can provide hydraulic power to propel the tractor and the equipment and, in drilling applications, to lubricate the drill bit. In such systems, the operating fluid may also provide the power necessary for enabling the tractor to grip the inner surface of the borehole. In comparison to rotary equipment, the use of coiled tubing in conjunction with a tractor is generally less expensive, easier to use, less time consuming to employ, and provides more control of speed and downhole loads. In addition, due to its greater compliance and flexibility, the coiled tubing permits the tractor to negotiate sharper turns in the borehole than rotary equipment.

Due to their versatility, self-propelled tractors may be used in a wide variety of applications. For example, a tractor may be used for well completion and production work for producing oil from an oil well, pipeline installation and maintenance, laying and movement of communication lines, well logging activities, washing and acidizing of sands and solids, retrieval of tools and debris, and the like. One type of tractor comprises an elongate body securable to the lower end of a drill string. The body may include one or more joined shafts attached to a control assembly housing or valve system.

Tractors generally include at least one anchor or gripper assembly adapted to grip the inner surface of the borehole. When the gripper assembly is actuated, hydraulic power from operating fluid may be used to propel the body axially through the borehole. The gripper assembly is longitudinally movably engaged with the tractor body, so that the body and drill string can move axially through the borehole while the gripper assembly is anchored to the inner surface of the passage. Several embodiments of a fluid-actuated gripper assembly are disclosed in U.S. Pat. No. 6,464,003 to Bloom et al. In one highly effective embodiment, the gripper assembly includes a plurality of flexible toes that expand radially outward by the interaction of ramps and rollers to engage, and thereby grip, the inner surface of the passage.

Tractors are commonly configured with two or more sets of gripper assemblies, which provide the ability to have at least one gripper anchored to the borehole at all times. This configuration permits the tractor to move in a substantially continuous manner within the passage. Forward longitudinal motion (unless otherwise indicated, the terms "longitudinal" and "axial" are herein used interchangeably and refer to the longitudinal axis of the tractor body) is achieved by powering the tractor body forward with respect to an actuated first gripper assembly (a "power stroke" with respect to the first gripper assembly), and simultaneously moving a retracted second gripper assembly forward with respect to the tractor body (a "reset stroke" of the second gripper assembly). At or near the completion of the power stroke with respect to the first gripper assembly, the second gripper assembly is actuated and the first gripper assembly is retracted. Then, the tractor body is powered forward while the second gripper assembly is actuated (a power stroke with respect to the second gripper assembly), and the retracted first gripper assembly executes a reset stroke. At or near the completion of these respective strokes, the first gripper assembly is actuated and the second gripper assembly is retracted. The cycle is then repeated. Thus, each gripper assembly operates in a cycle of actuation, power stroke, retraction, and reset stroke, resulting in longitudinal motion of the tractor.

A number of highly effective tractor designs utilizing this configuration are disclosed in U.S. Pat. No. 6,003,606 to Moore et al., which discloses several embodiments of a tractor known as the "Puller-Thruster Downhole Tool;" U.S. Pat.

No. 6,241,031 to Beaufort et al.; and U.S. Pat. No. 6,347,674 to Bloom et al., which discloses an "Electrically Sequenced Tractor" ("EST").

As discussed above, the power required for actuating the gripper assemblies, longitudinally thrusting the tractor body during power strokes, and longitudinally resetting the gripper assemblies during reset strokes may be provided by pressurized operating fluid delivered to the tractor via the drill string. Typically, one or more flow control devices, such as valves, are provided within the tractor body for distributing the operating fluid to the tractor's gripper assemblies, thrust chambers, and reset chambers.

Some types of tractors, including several embodiments of the Puller-Thruster Downhole Tool, are entirely hydraulically powered. Pressure-responsive valves typically shuttle between various positions based upon the pressure of the operating fluid in various locations of the tractor. In one configuration, a pressure-responsive valve may take the form of a spool valve that is exposed on both ends to different fluid chambers or passages. As a result, the valve position depends on the differential pressure between the fluid chambers. Fluid having a higher pressure in a first chamber exerts a greater force on the valve than fluid having a lower pressure in a second chamber, forcing the valve to one extreme position. The valve moves to another extreme position when the pressure in the second chamber is greater than the pressure in the first chamber. Another type of pressure-responsive valve takes the form of a spring-biased spool valve having at least one end exposed to fluid. The fluid pressure force is directed opposite to the spring biasing force, so that the valve is opened or closed only when the fluid pressure exceeds a threshold value.

In other configurations, tractors may be provided with one or more valves that are controlled by electrical signals sent from a control system at the surface or even on the tractor itself. For example, the aforementioned EST includes both electrically controlled valves and pressure-responsive valves. The electrically controlled valves are controlled by electrical control signals sent from a controller housed within the tractor body. For drilling operations, the EST may be preferred over all-hydraulic tractors because electrical control of the valves permits very precise control over important drilling parameters, such as speed, position, and thrust.

In contrast, all-hydraulic tractors, including several embodiments of the Puller-Thruster Downhole Tool, are generally preferred for so-called "intervention" operations. As used herein, the term "intervention" refers to re-entry into a previously drilled well for the purpose of improving well production, to thereby improve fuel production rates. As wells age, the rate at which fuel can be extracted therefrom diminishes for several reasons. This necessitates the "intervention" of many different types of tools. Hydraulic tractors are generally preferred over electrically controlled tractors for intervention operations because hydraulic tractors are less expensive to operate and intervention operations do not require precise control of speed or position.

Tractors used in combination with coiled tubing equipment are particularly useful for intervention operations because, in many cases, the wells were originally drilled with rotary drilling equipment capable of drilling very deep holes. It is more expensive to bring back the rotary equipment than it is to bring in a coiled tubing unit. However, in many situations, the coiled tubing unit may not be capable of reaching extended distances within the borehole without the aid of a tractor. The tractor is particularly useful for reaching locations within inclined or horizontal boreholes.

Those skilled in the art appreciate that tractors of the type generally described above may be exposed to a wide variety of different conditions. For example, depending on the particular application, the pressure, weight, and density of the operating fluid may vary significantly. Furthermore, the shape and angle of the borehole may vary. In addition, the weight of the equipment that the tractor must pull and/or push will differ with the particular application.

SUMMARY OF THE INVENTION

Although tractors may be exposed to a wide variety of conditions, the inventors have found that existing tractors, and particularly all-hydraulic tractors, are configured to operate effectively within only a relatively limited range of conditions. This can be a significant shortcoming that increases costs and limits the effectiveness of tractors in the field.

Therefore, an improved valve system is desired for enabling a tractor to operate effectively under a wider variety of conditions. In one embodiment, such a valve system is capable of controlling the tractor operation independently of the tractor's load and speed. It may also be desirable that such a valve system is not susceptible to premature valve shifting when exposed to fluctuations in the pressure of the operating fluid. It may also be desirable that such a valve system protects its internal components from damage. It may also be desirable that such a valve system allows the tractor to be operated relatively inexpensively and simplifies use of the tractor in the field by reducing or eliminating the steps for calibration, operation and downhole trouble-shooting. It may also be desirable that such a valve system be adapted for use under a wide range of flow rates and is compatible with a wide variety of BHA components. It is also desirable that such a valve system provides for highly efficient movement by reducing unnecessary dwell times between steps in the operational sequence.

The pressure of the operating fluid within a tractor may fluctuate substantially as the valve system directs fluid to actuate the grippers and/or power the pistons (or other similar mechanism) during advancement of the tractor through the passage. In certain applications, it is not uncommon for the pressure to fluctuate as much as one thousand psi. During field use, the inventors have found that the pressure fluctuations can render other tools inoperable or incompatible, particularly if the other tools are adapted for use within a limited range of pressure. As a result, the user's ability to use the tractor in combination with other tools may be limited.

Furthermore, the inventors have found that the large pressure cycles add undesirable fatigue cycles to the internal tractor components and/or to the attached tools. This may limit the design life of the tractor and/or other attached tools and can thereby significantly impact the operating cost of using the tractor.

Still further, the inventors have found that pressure-actuated valves may be susceptible to premature shifting due to pressure spikes or other large fluid pressure fluctuations. Similarly, testing has shown that the valves may be particularly susceptible to premature shifting when the tractor system is subjected to heavy loads, and/or large dynamic pressure waves (or "water hammer" effects) caused by the opening and closing of other valves within the control assembly. In certain applications, premature valve shifting may significantly limit the operational range and efficiency of the tractor.

In various embodiments of the present invention, there is provided an improved valve system adapted for use with a tractor that overcomes the above-mentioned problems of the prior art. These embodiments represent a major advancement in the art of tractors, and particular in the art of well intervention tools. Compared to the prior art, certain embodiments of the improved valve system can provide for greater control of tractor movement and operate very effectively within a much larger zone of parameters. In addition, by providing for better control over the fluid pressure, certain embodiments of the improved valve system can extend the useful life of internal components and thereby reduce operating costs.

In one aspect, a tractor for moving a component through a borehole comprises an elongate body with aft and forward gripper assemblies longitudinally movably engaged thereon. The aft and forward gripper assemblies are preferably hydraulically actuated for selectively engaging an inner surface of the borehole. Aft and forward propulsion assemblies are provided for advancing the body through the borehole relative to the aft and forward gripper assemblies, respectively. A gripper control valve is provided for directing pressurized fluid to the aft and forward gripper assemblies. The gripper control valve preferably has a first position for directing pressurized fluid to the aft gripper assembly and a second position for directing pressurized fluid to the forward gripper assembly. In a significant feature, aft and forward mechanically actuated valves disposed along the body for detecting advancement of the body relative to said aft or forward gripper assembly, respectively, thereby providing a mechanism for improving the timing and efficiency of the tractor operation. In particular, the aft and forward mechanically actuated valves are in fluid communication with the gripper control valve for causing the gripper control valve to change positions after the body has completed an advancement stroke through the borehole relative to said aft or forward gripper assembly.

In another aspect, a tractor for moving a component through a borehole comprises an elongate body having an internal passage extending therethrough for providing pressurized fluid to a bottom hole assembly. Aft and forward gripper assemblies longitudinally are slidably coupled to the elongate body. The aft and forward gripper assemblies are preferably hydraulically actuated for selectively engaging an inner surface of the borehole. Aft and forward propulsion assemblies are provided for advancing the body through the borehole relative to the aft and forward gripper assemblies, respectively. A gripper control valve is provided for directing pressurized fluid to the aft and forward gripper assemblies. The gripper control valve preferably has a first position for directing pressurized fluid to the aft gripper assembly and a second position for directing pressurized fluid to the forward gripper assembly. A propulsion control valve is also disposed within the body and has a first position for directing pressurized fluid to the aft propulsion assembly and a second position for directing pressurized fluid to the forward propulsion assembly. A supply line provides pressurized fluid from a supply source at a location on the surface to the gripper control valve and the gripper control valve. A pressure relief valve is disposed within said body of the tractor for regulating fluid pressure in the internal passage. The pressure relief valve also regulates the pressure of the fluid entering through the valve system of the tractor. In one variation, the valve system may include a start-stop valve which prevent fluid from entering the gripper control valve and propulsion control valve. The outlet from the start-stop valve may be used to pilot the pressure relief valve, thereby providing a mechanism for turning off the pressure relief valve when desired.

In yet another aspect, a tractor for moving a component through a borehole comprises an elongate body formed with an internal passage extending longitudinally therethrough. Aft and forward gripper assemblies are slidably coupled to the elongate body. The aft and forward gripper assemblies are preferably hydraulically actuated for selectively engaging an inner surface of the borehole. Aft and forward propulsion assemblies are adapted for advancing said body through the borehole relative to the aft and forward gripper assemblies, respectively. A hydraulic valve system is housed within the elongate body and is configured for receiving a portion of the pressurized fluid from the internal passage and directing the fluid to the aft or forward gripper assembly in a desired sequence for effecting movement of the tractor through the borehole. A pressure relief valve is provided for limiting fluid pressure within the internal passage and the hydraulic valve system, wherein the pressure relief valve is adapted to vent fluid from the internal passage to an annulus when the fluid pressure in the internal passage exceeds a pre-selected threshold. A first fluid path extends from said internal passage to the hydraulic valve system. A second fluid path extends from the internal passage to the pressure relief valve.

In still another aspect, an apparatus for moving through a borehole comprises an elongate body formed with an internal passage extending longitudinally therethrough. Aft and forward gripper assemblies are slidably coupled to the elongate body. The aft and forward gripper assemblies are preferably hydraulically actuated for selectively engaging an inner surface of the borehole. Aft and forward propulsion assemblies are adapted for advancing said body through the borehole relative to the aft and forward gripper assemblies, respectively. A hydraulic valve system is housed within the elongate body and is configured for receiving a portion of the pressurized fluid from the internal passage and directing the fluid to the aft or forward gripper assembly in a desired sequence for effecting movement of the tractor through the borehole. A pressure relief valve is provided for limiting fluid pressure within the internal passage and the hydraulic valve system, wherein the pressure relief valve is adapted to vent fluid from the internal passage to an annulus when the fluid pressure in the internal passage exceeds a pre-selected threshold. A first fluid path extends from said internal passage to the hydraulic valve system. A second fluid path extends from the internal passage to the pressure relief valve.

These and other embodiments are intended to be within the scope of the invention disclosed herein. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENT

Figure 1:
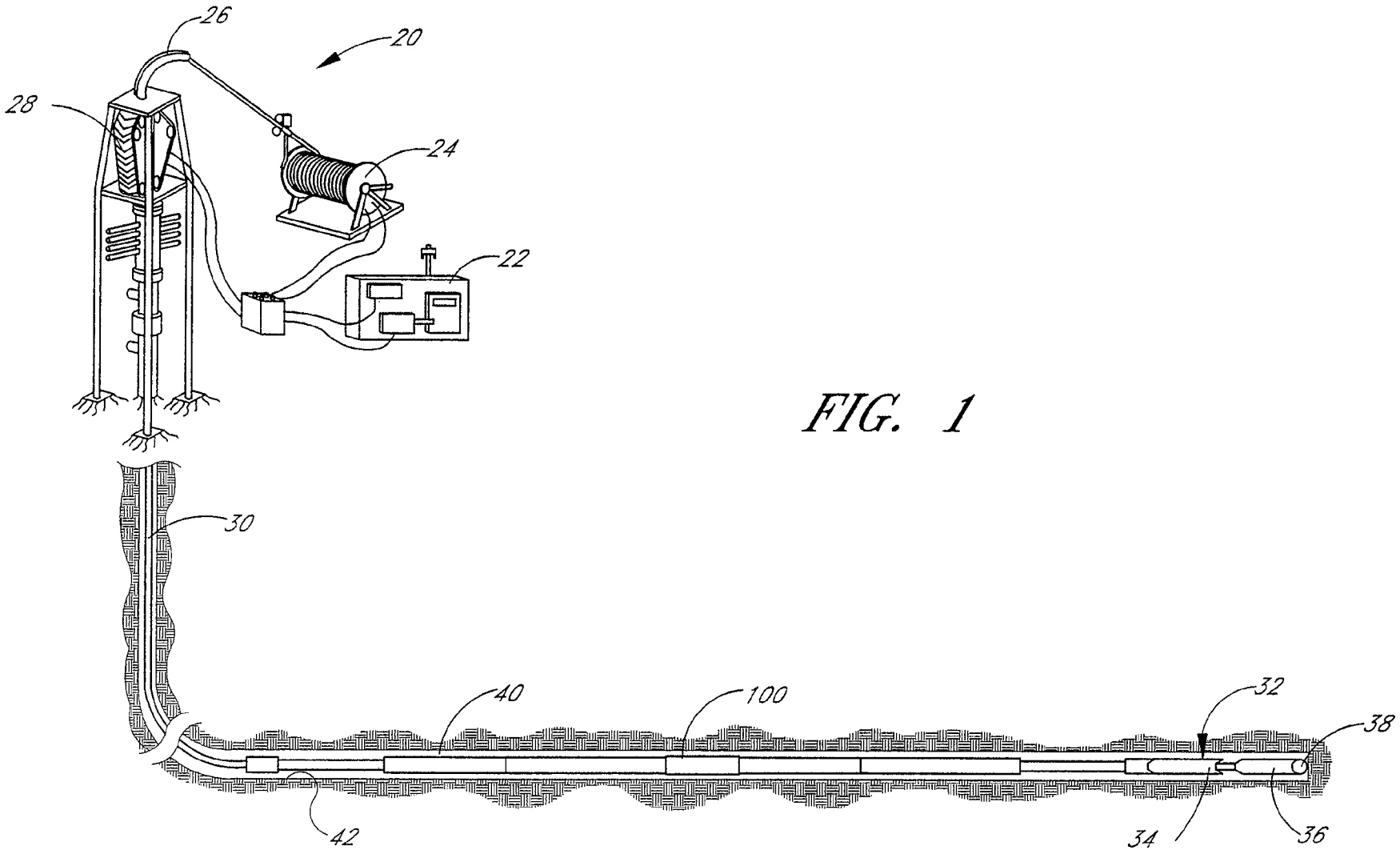
FIG. 1 is a schematic diagram of the major components of one embodiment of a tractor of the present invention, utilized in conjunction with a coiled tubing system.

FIG. 1 is a schematic diagram illustrating a hydraulic tractor 100 during use for moving equipment within a passage. The tractor is shown being used in conjunction with a coiled tubing drilling system 20 and adjoining downhole equipment 32. The coiled tubing drilling system 20 may include a power supply 22, tubing reel 24, tubing guide 26, tubing injector 28, and coiled tubing 30, all of which are well known in the art. The tractor 100 is configured to move within a borehole having an inner surface 42. An annulus 40 is provided in the space between the outer surface of the tractor 100 and the inner surface 42 of the borehole.

The downhole equipment 32 may include various types of equipment that the tractor 100 is designed to move within the passage. For example, the equipment 32 may comprise a perforation gun assembly, an acidizing assembly, a sand-washing assembly, a bore plug setting assembly, an E-line, a logging assembly, a bore casing assembly, a measurement while drilling (MWD) assembly, or a fishing tool. Alternatively, the equipment 32 may comprise a combination of these items. If the tractor 100 is used for drilling, the equipment 32 will preferably include an MWD system 34, a downhole motor 36, and a drill bit 38, all of which are also known in the art. Of course, the downhole equipment 32 may include many other types of equipment for non-drilling applications, such as intervention and completion applications. While the equipment 32 is illustrated on the forward end of the tractor, in alternative configurations, the downhole equipment may be connected aft and/or forward of the tractor.

It will be appreciated by those skilled in the art that a hydraulic tractor of the type shown may be used to move a wide variety of tools and equipment within a borehole or other passage. For example, the tractor can be utilized for well completion and production work, pipeline installation and maintenance, laying and movement of communication lines, well logging activities, washing and acidizing of sands and solids, retrieval of tools and debris, and the like. Also, while preferred for intervention operations, the tractor may also be used for drilling applications, including petroleum drilling and mineral deposit drilling. The tractor can be used in conjunction with different types of drilling equipment, including rotary drilling equipment and coiled tubing equipment.

One of ordinary skill in the art will understand that oil and gas well completion typically requires that the reservoir be logged using a variety of sensors. These sensors may operate using resistivity, radioactivity, acoustics, and the like. Other logging activities include measurement of formation dip and borehole geometry, formation sampling, and production logging. With the help of a tractor, these completion activities can be accomplished in a variety of inclined and horizontal boreholes. For instance, the tractor can deliver these various types of logging sensors to regions of interest. The tractor can either place the sensors in the desired location, or it can idle in a stationary position to allow the measurements to be taken at the desired locations. The tractor can also be used to retrieve the sensors from the well.

Examples of production work that can be performed with a hydraulic tractor include sands and solids washing and acidizing. It is known that wells sometimes become clogged with sand, hydrocarbon debris, and other solids that prevent the free flow of oil through the borehole. To remove this debris, specially designed washing tools are delivered to the region and fluid is injected to wash the region. The fluid and debris then return to the surface. Such tools include acid washing tools. These washing tools can be delivered to the region of interest for performance of washing activity and then returned to the ground surface by a preferred embodiment of the tractor of the invention.

In another example, a hydraulic tractor can be used to retrieve objects, such as, for example, damaged equipment and debris, from the borehole. Equipment may become separated from the drill string, or objects may fall into the borehole. These objects must be retrieved, or the borehole must be abandoned and plugged. Because abandonment and plugging of a borehole is very expensive, retrieval of the object is usually preferred if possible. A variety of retrieval tools known to the industry are available to capture these lost objects. In use, the tractor is used to transport retrieving tools to the appropriate location, retrieve the object, and then return the retrieved object to the surface.

In yet another example, a hydraulic tractor can be used for coiled tubing completions. As known in the art, continuous-completion drill string deployment is becoming increasingly important in areas where it is undesirable to damage sensitive formations in order to run production tubing. These operations require the installation and retrieval of fully assembled completion drill string in boreholes with surface pressure. The tractor can be used in conjunction with the deployment of conventional velocity string and simple primary production tubing installations. The tractor can also be used with the deployment of artificial lift devices such as gas lift and downhole flow control devices.

In yet another example, a tractor can be used to service plugged pipelines or other similar passages. Frequently, pipelines are difficult to service due to physical constraints such as location in deep water or proximity to metropolitan areas. Various types of cleaning devices are currently available for cleaning pipelines. These various types of cleaning tools can be attached to the tractor so that the cleaning tools can be moved within the pipeline.

In still another example, a tractor can be used to move communication lines or equipment within a passage. Frequently, it is desirable to run or move various types of cables or communication lines through various types of conduits. The tractor can move these cables to the desired location within a passage.

Overview of Tractor Components

Figure 2:
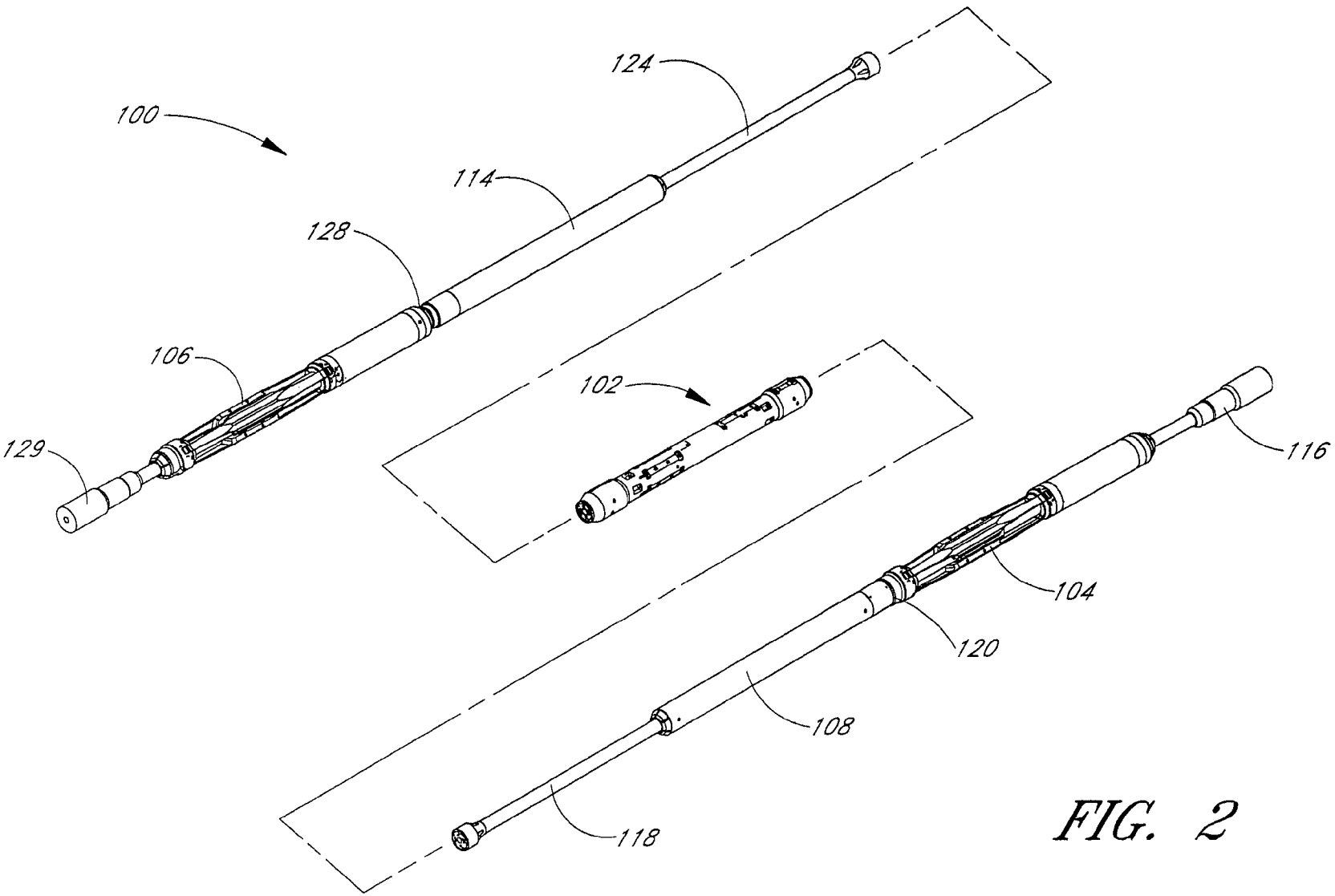
FIG. 2 is a front perspective view of a preferred embodiment of the tractor.

FIG. 2 illustrates one preferred embodiment of the tractor 100, shown with the aft end on the left and the forward end on the right. The tractor 100 generally comprises a central control assembly 102, an aft gripper assembly 104, a forward gripper assembly 106, an aft propulsion cylinder 108, a forward propulsion cylinder 114, an aft shaft assembly 118, a forward shaft assembly 124, tool joint assemblies 116 and 129, and flex joints or adapters 120 and 128. The tool joint assembly 116 is disposed along the aft end of the aft shaft assembly 118 for connecting the drill string (e.g., coiled tubing) to the aft shaft assembly 118. The aft gripper assembly 104, aft propulsion cylinder 108, and flex joint 120 are assembled together end-to-end and are all axially slidably engaged with the aft shaft assembly 118. Similarly, the forward gripper assembly 106, forward propulsion cylinders 114, and flex joint 128 are assembled together end-to-end and are axially slidably engaged with the forward shaft assembly 124. The tool joint assembly 129 is preferably configured for coupling the tractor 100 to downhole equipment 32, as shown in FIG. 1. The aft shaft assembly 118, the control assembly 200 and the forward shaft assembly 124 are axially fixed with respect to one another and are generally referred to herein as the body of the tractor. Conventionally, the body of the tractor is axially fixed with respect to the drill string and the downhole tools.

The gripper assemblies 104, 106 and propulsion cylinders 108, 114 are axially slidable along the body for providing the tractor 100 with the capability of pulling and/or pushing downhole equipment 32 of various weights through the borehole (or passage). In one embodiment, the tractor 100 is capable of pulling and/or pushing a total weight of 100 lbs, in addition to the weight of the tractor itself. In various other embodiments, the tractor is capable of pulling and/or pushing a total weight of 500, 3000, and 15,000 lbs.

In order to prevent damage to a surrounding formation or casing wall, the gripper assemblies 104, 106 are preferably constructed to limit the radial gripping load (i.e., force) exerted on a surface. In one embodiment, the gripper assemblies 104, 106 exert no more than 25 psi on a surface surrounding the tractor. This embodiment is particularly useful in softer formations, such as gumbo. In various other embodiments, the gripper assemblies 104, 106 exert no more than 100, 3000, and 50,000 psi on a surface surrounding the tractor. At radial gripping loads of 50,000 psi or less, the tractor generally can be used safely in steel tube casing.

The tractor 100 preferably receives pressurized operating fluid from a supply source at the surface. A supply line extends down from the surface and passes through an internal passage in the tractor for supplying operating fluid to the downhole equipment. As the operating fluid passes through the internal passage, a portion of the operating fluid is diverted into the control assembly 102 for providing hydraulic power to the tractor. More particularly, the control assembly 102 houses a valve system that distributes operating fluid to and from the gripper assemblies 104, 106 and the propulsion cylinders 108, 114 for controlling tractor movement. Preferred embodiments of the control assembly and the valve system are described in more detail below. Using the specification and figures of the present application along with the principles of design and space management known to those skilled in the art through Applicant's co-owned U.S. Pat. Nos. 6,347,674 and 6,679,341, one of ordinary skill in the art will understand how to build a tractor having an improved valve system as described herein.

The tractor 100 can be any desirable length, but for oilfield applications the length is typically approximately 25 to 35 feet. The maximum diameter of the tractor will vary with the size of the hole, thrust requirements, and the restrictions that the tractor must pass through. The gripper assemblies 104, 106 can be designed to operate within boreholes of various sizes, but typically are configured to expand to a diameter of 3.75 to 7.0 inches.

The flex adapters 120 and 128 are preferably hollow structural members that provide a region of reduced flexural rigidity (i.e., increased flexibility). This region of reduced flexural rigidity facilitates the tractor's ability to negotiate sharp turns. In one preferred embodiment, the adapters are formed of a relatively low modulus material such as Copper Beryllium (CuBe) and/or Titanium. Occasionally, there are applications that require the use of non-magnetic materials for the tractor. Otherwise, depending on the required turning capability of the tractor and resultant stresses, various stainless steels may be used in many areas of the tractor.

The tool joint assembly 116 preferably couples the aft end of the aft shaft assembly 118 to a coiled tubing drill string, preferably via a threaded connection. As discussed above, downhole equipment may also be placed at the aft end of the tractor, connected to the tool joint assembly 116. However, in a typical operation, the tool joint assembly 129 will be coupled to downhole equipment. The interface threads of the tool joint assemblies are preferably API threads or proprietary threads (such as Hydril casing threads). The tool joint assemblies can be prepared with conventional equipment (tongs) to a specified torque (e.g., 1000-3000 ft-lbs). The tool joint assemblies can be formed from a variety of materials, including CuBe, steel, and other metals.

As discussed above, the aft and forward shaft assemblies 118 and 124, along with the control assembly 102, form the body of the tractor 100. The aft and forward shaft assemblies 118 and 124 are each preferably formed with a segment having an expanded diameter that forms a piston. Preferably, the aft and forward pistons have outer diameters that are substantially similar to the inner diameters of the aft and forward propulsion cylinders 104, 108. The aft and forward pistons are slidably housed within the aft and forward propulsion cylinders 104, 108 and separate the interiors of each cylinder into a power chamber and a reset chamber. Accordingly, the aft and forward propulsion cylinder 104, 108 form, at least in part, aft and forward propulsion assemblies that are configured for advancing the tractor body through the borehole relative to the aft and forward gripper assemblies. Although preferred embodiments of the tractor utilize aft and forward propulsion cylinders, it will be appreciated that a wide variety of aft and forward propulsion assemblies may be used for producing advancement of the tractor body.

As will be described in more detail below, pressurized fluid is alternately directed to the power chamber in the aft or forward propulsion cylinder for propelling the body through the borehole when the aft or forward gripper assembly is anchored to the inner surface. Pressurized fluid is alternately directed to the reset chamber in the aft or forward propulsion cylinder for resetting the position of the aft or forward gripper assembly relative to the body (i.e., in preparation for another power stroke) while the aft or forward gripper assembly is disengaged. Accordingly, the tractor steps through the borehole by thrusting itself forward relative to the aft or forward gripper assembly.

The aft and forward shaft assemblies 118 and 124 may be constructed from any suitable material. In one preferred embodiment, the shafts are formed from a flexible material, such as CuBe, in order to permit the tractor 100 to negotiate sharper turns. In other embodiments CuBe is not used, as it is relatively expensive. Other acceptable materials include Titanium and steel (when low flexibility is sufficient). In a preferred configuration, each shaft includes a central internal bore which together form, in part, the internal passage for the flow of pressurized operating fluid to the downhole equipment and to the control assembly 102. The bore in each shaft assembly preferably extends the entire length of the shaft. Each shaft may also include numerous other passages for the flow of fluid to the gripper assemblies and propulsion cylinders. These fluid passages range in length and are equal to or less than the overall length of the tractor. Multiple fluid passages can be drilled in the shaft for the same function, such as to feed a single propulsion chamber. Preferably, the bore and the other internal fluid passages are arranged so as to minimize stress and provide sufficient space and strength for other design features, such as the pistons slidably housed within the cylinders. Each shaft is preferably provided with threads on one end for connection to the tool joint assemblies 116 and 129, and with a flange on the other end to allow bolting to the control assembly 102.

It will be appreciated by those skilled in the art that the tractor 100 described herein is particularly well adapted for intervention applications. While intervention tractors can be made any size, they are typically operated within 5-inch or 7-inch casing. The inside diameter of a 5-inch casing can range from 4.5 to 4.8 inches. The inside diameter of a 7-inch casing can range from 5.8 to 6.4 inches. The primary structural components of the tractor 100 are the shafts 118 and 124. In a preferred embodiment, the shafts have an outside diameter of 1.75 inches and an inside bore diameter of 0.8 inches. The remaining fluid passages of the shafts are preferably smaller. The pistons can have varying outside diameters.

For intervention applications, the tractor 100 described herein is very reliable and efficient. Prior art intervention tools that utilize rotary drill strings are as much as 150% more expensive than the illustrated tractor 100 used with coiled tubing equipment. In addition, the tractor 100 is more time-conservative, as the longer rig-up time associated with rotary equipment is avoided. Furthermore, the use of coiled tubing is particularly advantageous when operating perforation guns.

The tractor 100 is at least in part hydraulically powered by the operating fluid pumped down the drill string, such as brine, sea water, drilling mud, or other hydraulic fluid. As discussed above, the same fluid supply line that operates the downhole equipment 32 (see FIG. 1) also preferably powers the tractor. This avoids the need to provide additional fluid channels in the tool. Preferably, liquid brine or sea water is used in an open system. Alternatively, fluid may be used in a closed system, if desired. Referring again to FIG. 1, in operation, operating fluid flows from the drill string 30 through the tractor 100 and down to the downhole equipment 32.

Preferred Configuration of Valve System

The control assembly 102 preferably houses a plurality of hydraulically and/or electrically controlled valves configured for selectively controlling the flow of operating fluid to and from the gripper assemblies 104 and 106 and to and from the propulsion cylinders 108 and 114 for producing tractor movement. It will be appreciated that the term "valve" as used herein is a broad term that generally refers to any device capable of regulating or controlling the distribution of fluid. Preferably, the valves contained within the control assembly 102 are entirely hydraulically controlled. Hydraulically controlled tractors are generally more desirable than electrically controlled valves, particularly for intervention applications, because they are less expensive and are generally safer to use in combination with certain types of downhole equipment, such as perforation guns. In addition, hydraulically controlled valves eliminate the need for electronic components, thereby saving space, which allows for larger internal flow passages. As a result, tractors using hydraulically controlled valves are generally faster and more powerful than tractors using electrically controlled valves.

Preferred embodiments of the present invention disclose an improved valve system that provides a significant improvement over valve systems known heretofore. For example, embodiments of the improved valve system disclosed herein provide much greater control of tractor movement as compared with existing hydraulically controlled tractors. The improved valve system also provides improved regulation of fluid pressure and allows the tractor to operate effectively within a larger zone of parameters. Furthermore, the improved valve system is configured to improve the reliability and extend the life of the internal components, thereby saving time and reducing costs. The entire disclosures of the following documents are incorporated by reference herein: (1) U.S. Pat. No. 6,347,674 to Bloom et al.; (2) U.S. Pat. No. 6,241,031 to Beaufort et al.; (3) U.S. Pat. No. 6,003,606 to Moore et al.; (4) U.S. Pat. No. 6,464,003 to Bloom et al.; (5) U.S. Provisional Patent Application Ser. No. 60/250,847, filed Dec. 1, 2000; and (6) U.S. Pat. No. 6,715,559.

Figure 3:
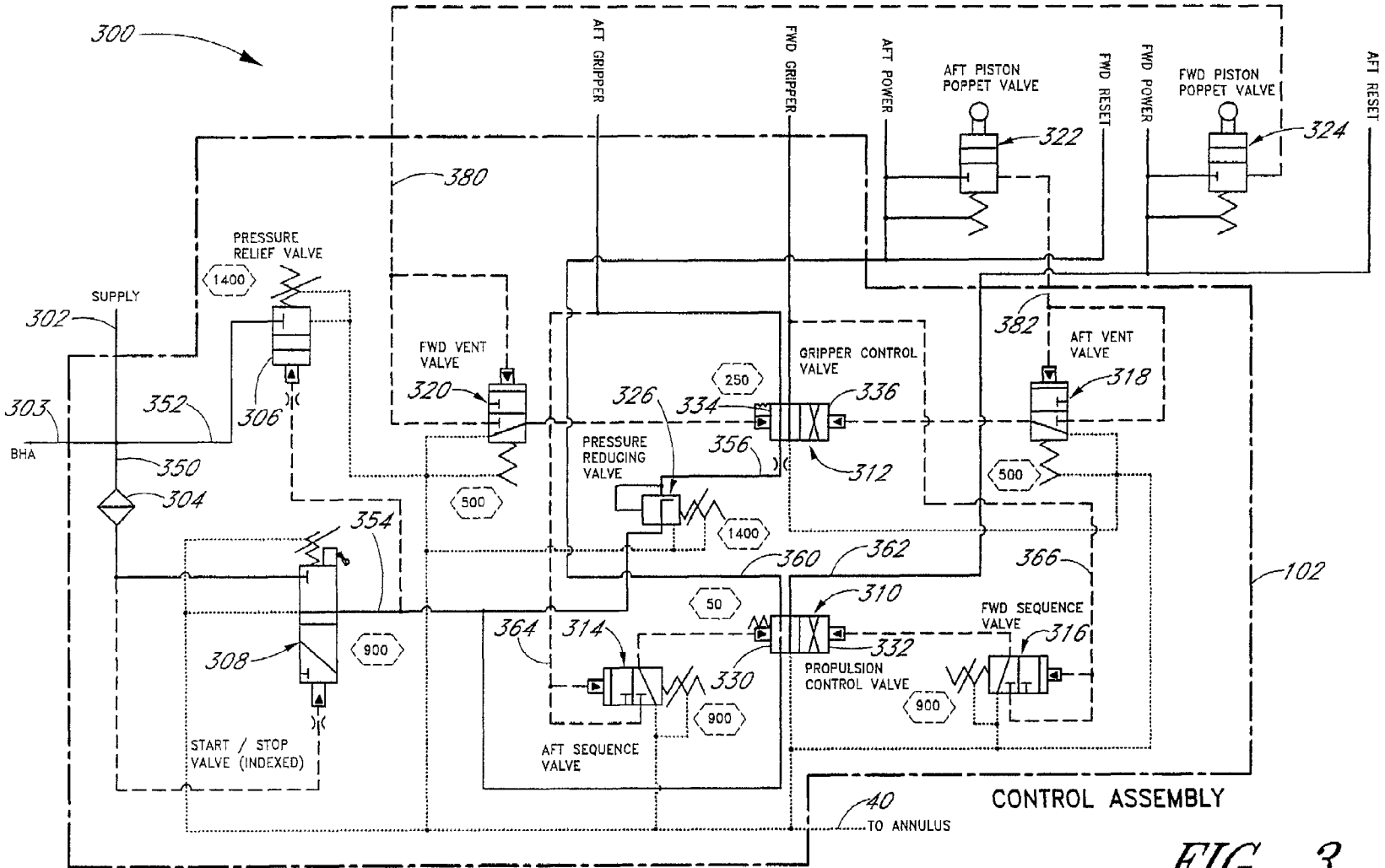
FIG. 3 is a schematic diagram illustrating a preferred embodiment of a valve control assembly for use with the tractor.

Referring now to FIG. 3, for purposes of illustration, one preferred embodiment of an improved valve system 300 is schematically shown. The portion of the valve system 300 housed within the control assembly 102 generally includes a start/stop valve 308, a propulsion control (or main sequence) valve 310, a gripper control (or pilot) valve 312, an aft sequence valve 314, a forward sequence valve 316, an aft vent valve 318, a forward vent valve 320 and a pressure reducing valve 326. In addition, a pressure relief valve 306 is provided for regulating the supply pressure in the internal passage. The pressure relief valve 306 is preferably included in the control assembly; however, the pressure relief valve may be located elsewhere, such as on the surface.

To effectively control the sequence of valve operation, it is desirable to accurately detect when the tractor body has completed an advancement stroke relative to the anchored aft or forward gripper assembly. Due to pressure fluctuations in the valve system, the use of pressure-responsive valves is not always effective for detecting and signaling the end of an advancement stroke. Accordingly, one embodiment of an improved valve system for an intervention tractor incorporates at least one mechanically actuated valve mechanism into the propulsion control assembly for quickly and accurately detecting and signaling the completion of a piston stroke.

In one preferred embodiment, the mechanically actuated valve is a poppet valve that is integrated into the piston. As the piston completes its stroke, the poppet valve (or other mechanically actuated valve) is mechanically actuated to open a seal and thereby allow fluid to pass through a passage. As a result, the outlet flow from the poppet valve may be used to actuate or pilot another valve. The use of a poppet valve to detect the end of the piston stroke, rather than a pressure-responsive valve, improves the efficiency and reliability of the hydraulic control assembly.

FIG. 3 schematically illustrates an aft piston poppet valve 322 and a forward piston poppet valve 324, each of which cooperates with the valves housed within the control assembly 102 to control tractor movement. As will be described in more detail below, the aft and forward piston poppet valves 322, 324 are preferably integrated into the aft and forward pistons on the aft and forward shaft assemblies. In preferred embodiments, the aft and forward piston poppet valves 322, 324 are preferably substantially identical in structure and operation.

Pressure Relief Valve

With continued reference to FIG. 3, one embodiment of an improved valve system is illustrated wherein the tractor receives pressurized fluid from the surface through a supply line 302. As the fluid enters the internal passage in the tractor body, a portion of the fluid from the supply line 302 is diverted to a pressure relief valve 306 along flow path 352. Also, a portion of the pressurized fluid from the supply line 302 is diverted to the start-stop valve 308 along flow path 350. The remaining pressurized fluid passes through the internal passage to the downhole equipment along flow path 303.

In the illustrated embodiment, the pressure relief valve 306 regulates the fluid pressure in the supply line 302. As a result, the pressure relief valve 306 also regulates the pressure of the "working" fluid that enters the start-stop valve 308 along flow path 350. The working fluid provides hydraulic power for producing movement of the tractor. Accordingly, it will be appreciated that the pressure relief valve regulates the pressure of the fluid entering the gripper assemblies 104, 106 and the propulsion cylinders 108, 114 (see FIG. 2). Still further, the pressure relief valve 306 regulates the pressure of the fluid that is supplied to the downhole equipment along flow path 303. Although the pressure relief valve is desirably housed within the control assembly (as shown in FIG. 3), the pressure relief valve may also be provided in other locations, such as along other portions of the tractor or on the surface.

In a preferred embodiment, the pressure relief valve 306 has a variable orifice that opens as a function of the fluid pressure. If the pressure in the supply line 302 increases rapidly, the variable orifice will open wider to vent more fluid. As a result, the pressure relief valve 306 responds quickly and fluid in the supply line 302 may be advantageously maintained at a regulated pressure.

During use, when the differential pressure between the supply line 302 and the annulus 40 increases above a pre-selected threshold pressure, the pressure relief valve 306 opens to vent fluid to the annulus 40, thereby lowering the pressure in the supply line. In various embodiments, the pre-selected threshold pressure is desirably at least 600 psid, 800 psid, 900 psid, 1100 psid, 1200 psid, 1400 psid and 1600 psid. In a preferred embodiment, the pre-selected threshold pressure is 1400 psid. Other pre-selected threshold pressures may also be desirable in some circumstances. The pressure relief valve is preferably sized for diverting fluid to the annulus 40 at a maximum rate of up to 20 to 25 gallons per minute. In preferred embodiments, the pressure relief valve 306 may be selectively rendered non-operational (i.e., turned off) when it is desirable to supply high-pressure fluid to the downhole equipment for certain operations.

The pressure relief valve 306 is particularly advantageous for use with valve systems that use a relatively large percentage of the flow through the supply line 302 for powering the tractor. Valve systems that use a large percentage of the system flow typically produce large pressure fluctuations in the system pressure during operation. For example, when the tractor completes a power stroke, the shifting in valve positions may temporarily stop the flow of fluid through the valve system. Without the pressure relief valve, the reduction in flow could produce a large swing in system pressure that could produce surges in motion, valve instability or stalling of the tractor. Accordingly, those skilled in the art will appreciate that the embodiments of the pressure relief valve 306 disclosed herein provide a significant advancement in the field of tractors.

Figure 4:
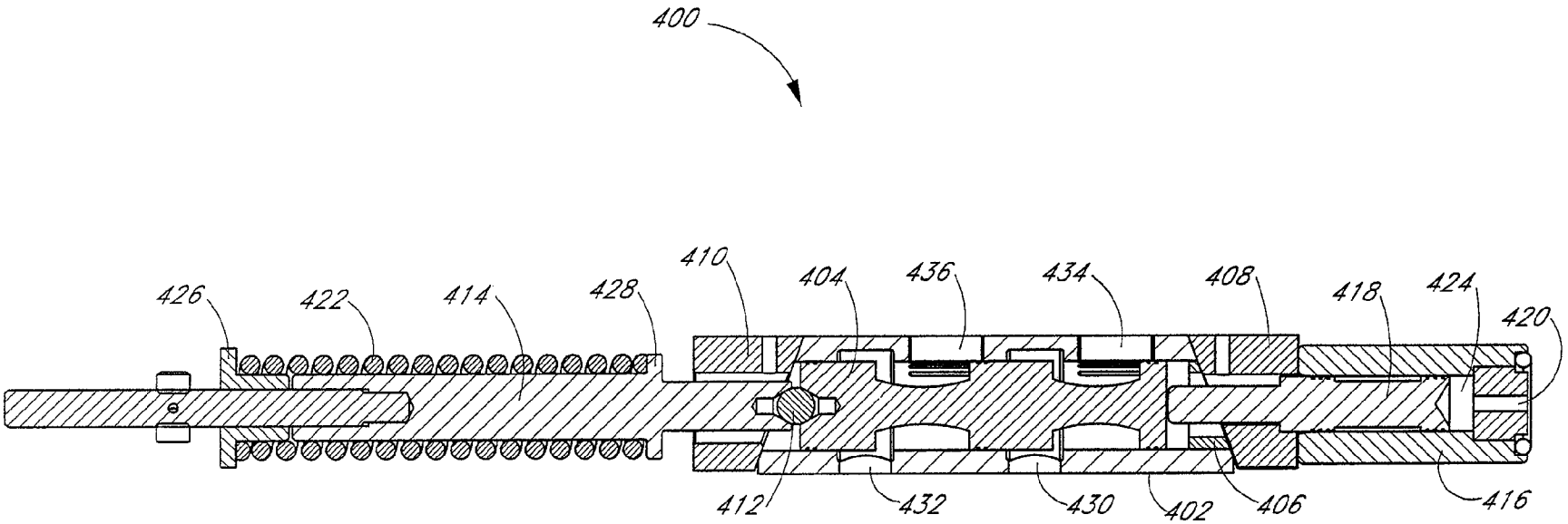
FIG. 4 is a longitudinal sectional view illustrating a preferred embodiment of a pressure relief valve.

With reference now to FIG. 4, a cross-sectional view of the internal components 400 of one preferred embodiment of a pressure relief valve is shown. The pressure-relief valve is preferably a pilot operated, spring return, two-position valve that is piloted by the pressure in the fluid path 354 from the start-stop valve 308 (as illustrated in FIG. 3). The internal components 400 of the pressure relief valve generally comprise a body 402 formed with a hollow interior and a spool 404 slidably housed within the hollow interior. First and second inlet ports 430, 432 and first and second outlet ports 434, 436 are provided through the body 402 for providing fluid communication with the hollow interior.

In the illustrated embodiment, a spring cartridge 414 is coupled to the left end of the spool 404 via a ball 412. The spring cartridge 414 and the spool 404 are axially fixed with respect to each other. The right end of the cartridge 414 is slidably maintained within the body 404 by a retainer 410. A coiled spring 422 extends around a middle portion of the spring cartridge 414. As illustrated, the left end of the spring 422 is in contact with a fixed stop 426, which prevents movement of the spring 422 away from the body 402 (to the left in FIG. 4). The spring 422 is preferably compressed between the fixed stop 426 and a flange 428 on the cartridge 414. The spring 404 provides a biasing force that urges the cartridge 414 and the spool 404 away from the body 402 (to the right in FIG. 4). Preferably, the pressure relief valve is configured such that the biasing force varies according to the pressure in the annulus such that the pressure relief valve operates off a differential pressure between the supply line and the annulus. A stop 406 is provided within the housing 402 for limiting the translation of the spool to the right. A pilot assembly 416 is attached to the right end of the body 402 opposite the spring 404. A pilot stem 418 is slidably housed within the pilot assembly 416 such that the left end of the stem 418 is in contact with the right end of the spool 404.

FIG. 4 shows the internal components 400 of the pressure relief valve in an open position such that pressurized fluid may pass therethrough. In operation, pressurized fluid enters the pilot assembly 416 through a pilot port 420. The fluid passes into a chamber 424 wherein the fluid pressure acts on one end of the pilot stem 418. When the spool is in contact with the stop 406, the inlet ports 430, 432 are blocked such that no fluid passes through the pressure relief valve. However, when the fluid pressure is sufficient to overcome the biasing force of the spring, the stem 418 moves to the left, thereby causing the spool 404 to translate to the left through the body 402. As the spool 404 moves to the left, the spring 422 is compressed. As the spool 404 translates to the left relative to the body 402, the inlet ports 430, 432 open to allow fluid to enter into the interior chamber of the body. The fluid passes around the spool and exits through the outlet ports 434, 436, preferably to the annulus. Due to the configuration of the spool and inlet ports, the first and second inlet ports 430, 432 open further as the spool moves further to the left to allow more fluid to pass therethrough. In a preferred configuration, the first and second inlet ports 430, 432 are staggered such that the first inlet port 430 opens before the second inlet port 432. Accordingly, the pressure relief valve vents only a small amount of fluid when the fluid pressure is only slightly above the threshold. However, when the fluid pressure is significantly larger than the threshold pressure, both the first and second inlet ports 430, 432 are open for allowing a large volume of fluid to pass.

With reference again to FIG. 3, the pressure relief valve 306 advantageously provides the ability to regulate the pressure of the fluid that is supplied to both the valve system (via flow path 350) and to the downhole equipment (via flow path 303). In one advantage of this arrangement, the working fluid entering the valve system is regulated independently of the tractor load and speed. In another advantage, the valve system is protected from large pressure fluctuations that can damage the internal hardware. In another advantage, the tractor is prevented from surging or stalling due to large pressure fluctuations in the supply line. Still further, because the pressure in flow path 303 is regulated, the tractor has improved compatibility with downhole equipment. Still further, the regulated pressure allows preferred embodiments of the tractor to be used over a substantially greater range of flow rates. The increased range further enhances the tractor's ability to be used with a wide variety of downhole equipment in a various field applications.

Start/Stop Valve

With reference again to FIG. 3, a portion of the pressurized fluid is preferably diverted from the supply line 302 (i.e., internal passage) into flow path 350 for providing hydraulic power to move the tractor through the borehole. Preferably, a filter 304 is provided along flow path 350 for removing particles from the fluid. The removal of large particles from the fluid protects internal valve system components (e.g., valve spools) that are used for controlling the operation of the tractor.

As illustrated in FIG. 3, the pressurized fluid in flow path 350 enters the start-stop valve 308. The start/stop valve 308 is preferably a pilot operated, spring return, indexed, two position, two-way valve that is piloted by the pressure of the fluid in flow path 350. When in a closed position, the start/stop valve 308 prevents fluid from passing through the valve system, thereby rendering the tractor non-operational. When in an open position, the start/stop valve 308 allows pressurized fluid to pass through to flow path 354. The pressurized fluid in flow path 354 flows to the propulsion control valve 310 and the pressure reducing valve 326, thereby allowing for tractor operation. The start-stop valve 308 is configured to move into the open position when the fluid pressure in flow path 350 (i.e., the supply line) exceeds a pre-selected threshold pressure. However, the start-stop valve 308 is preferably indexed such that the valve may be selectively prevented from opening when the fluid pressure exceeds the pre-selected threshold.

Figure 5:
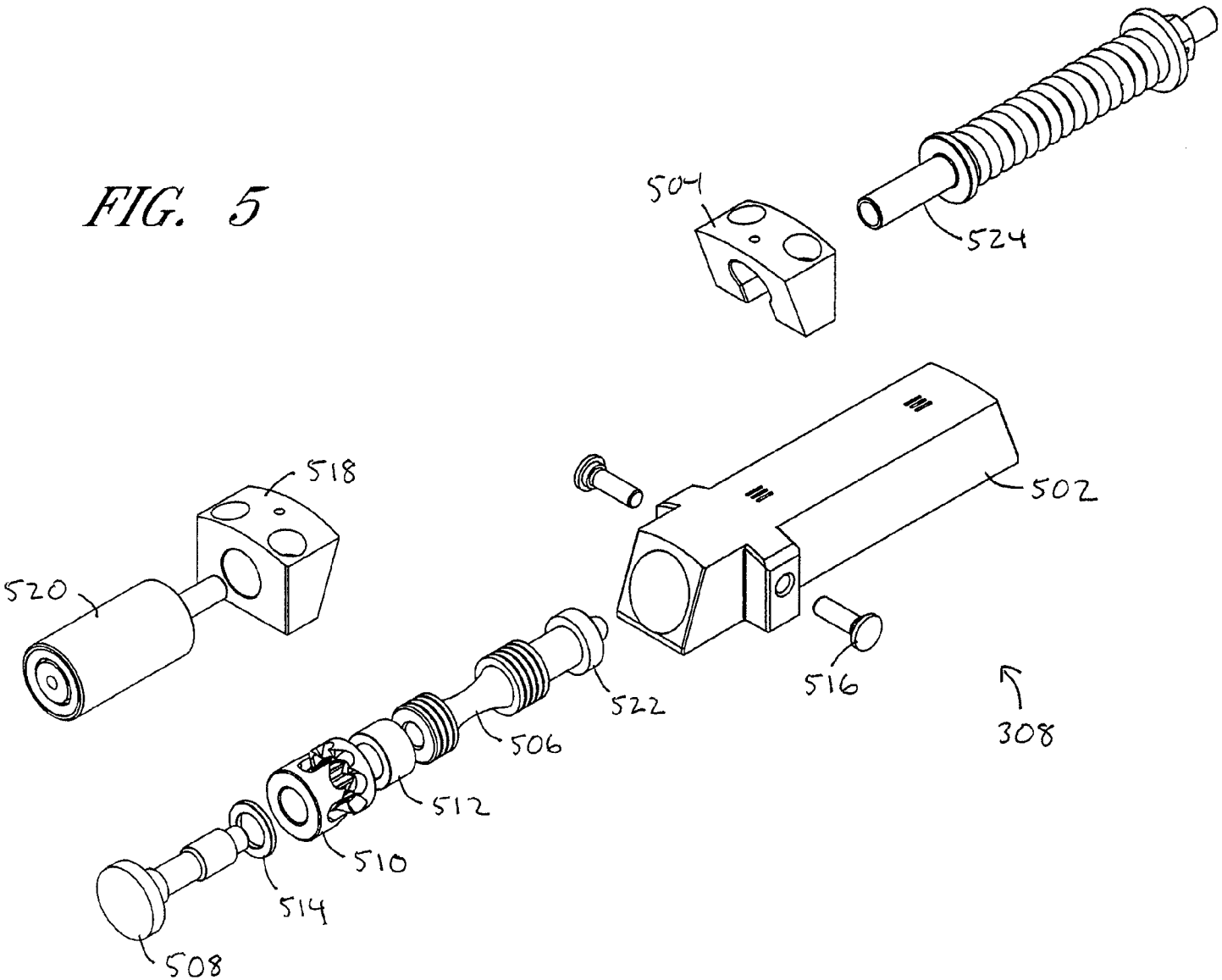
FIG. 5 is an exploded view illustrating the components of a preferred embodiment of a start-stop valve.

With reference now to FIG. 5, an exploded view of one preferred embodiment of a start-stop valve 308 is shown. The primary components of the start-stop valve 308 generally comprise a body 502 formed with a hollow interior and a spool 506 slidably housed within the hollow interior. The slidable spool 506 is preferably coupled at a first end to a spring cartridge 524 via a ball 522. In one embodiment, the ball 522 is made of stainless steel. The spool 506 is preferably coupled at a second end to an index sleeve 510 with a spacer 512 located therebetween. An index guide 508 extends through a center portion of the index sleeve 510 and a washer 514 is provided therebetween. The spool 506, the index guide 508, and the index sleeve 510 are all slidably housed within the body 502. The spring cartridge 524 is preferably coupled to a first end of the body 502 by a slotted retainer 504. The spring cartridge is configured to urge the spool 506 into the closed position. A pilot assembly 520 is preferably coupled to a second end of the body 502 via a retainer 518. Under sufficient fluid pressure, the pilot assembly 520 compresses the spring on the spring cartridge 524 for changing the position of the index sleeve 510 and moving the spool into the open position.

During use, as the pressure in the flow path 350 increases above a pre-selected threshold (e.g., 900 psi), the fluid pressure acts on the pilot assembly 520, which in turn causes the index sleeve 510 to rotate about the index guide 508. The rotational position of the index sleeve 510 determines whether the start-stop valve 308 opens or remains closed as the pressure of the fluid increases above the pre-selected threshold. Accordingly, the start-stop valve 308 provides a mechanism for turning the tractor on and off by varying the supply pressure. If the index sleeve 510 is in the off position, a pressure cycle (e.g., dropping the pressure to 0 psi and then back up to 900 psi) will change the index sleeve 510 into the on position. When the index sleeve 510 is in the on position, the spool may slide within the hollow interior of the body 502 for opening a passage between the inlet and outlet ports (not shown) and thereby allowing fluid to pass through the start-stop valve 308. More details on valves having indexed drums can be found in U.S. Pat. No. 6,679,341, which is incorporated herein by reference.

With reference again to FIG. 3, in preferred embodiments, the fluid pressure in the flow path 354 from the start-stop valve 308 is used to pilot the pressure relief valve 306. As a result, the pressure relief valve 306 is only operational when the start-stop valve 308 is in the open position. Accordingly, the pressure relief valve 306 is effectively "turned off" when the index sleeve is in the off position such that the start-stop valve will not open regardless of the fluid pressure in flow path 350. This is an important feature because it allows the fluid pressure in the internal passage 302, 303 to be increased above the pressure threshold of the pressure relief valve. This advantageously allows the operator to provide fluid at any pressure to a bottom hole assembly or other downhole equipment when desired.

Propulsion Control Valve

As discussed above, when the start/stop valve 308 is open, pressurized operating fluid flows through the passage 354 to the propulsion control valve 310. In a preferred embodiment, the propulsion control valve 310 is a two-position, sliding-spool directional flow valve. In a first position, as shown in FIG. 3, the spool of the valve 310 provides a flow path 360 for the flow of fluid to the power chamber of the aft cylinder, and also to the reset chamber of the forward cylinder. In the first position, the valve 310 also provides a flow path 362 for the flow of fluid from the power chamber of the forward cylinder to the annulus 40, and from the reset chamber of the aft cylinder to the annulus 40.

The spool of the propulsion control valve 310 also has a second position, (e.g., which would be shifted to the left in FIG. 3). When the spool of the valve 310 is in its second position, the valve 310 provides a flow path 362 for the flow of fluid to the power chamber of the forward cylinder, and also to the reset chamber of the aft cylinder. In the second position, the valve 310 also provides a flow path 360 for the flow of fluid from the power chamber of the aft cylinder to the annulus 40, and also from the reset chamber of the forward cylinder to the annulus 40.

With continued reference to FIG. 3, the spool of the propulsion control valve 310 has a first end surface 330 and a second end surface 332. The first end surface 330 is in fluid communication with the aft gripper assembly along fluid path 364. The second end surface 332 is in fluid communication with the forward gripper assembly along fluid path 366. The first and second end surfaces 330 and 332 of the propulsion control valve 310 are configured to receive respective fluid pressure forces that act on the valve spool. The first end surface 330 receives a pressure force from the fluid in the aft gripper assembly that tends to move the spool of the valve 310 toward its first position, (e.g., to the right as shown in FIG. 3). The second end surface 332 receives a pressure force from the fluid in the forward gripper assembly that tends to move the spool toward its second position, (e.g., which would be shifted to the left in FIG. 3).

Aft and Forward Sequence Valves

With continued reference to FIG. 3, an aft sequence valve 314 is preferably provided along the fluid path 364 extending from the aft gripper assembly to the first end surface 330. In addition, a forward sequence valve 316 is preferably provided along the fluid path 366 extending from the forward gripper assembly to the second end surface 332.

Referring only to the aft sequence valve 314 for purposes of illustration, the aft sequence valve 314 opens when the fluid pressure in the flow path 364 exceeds a pre-selected threshold (e.g., 900 psid). When the aft sequence valve 314 is open, the fluid pressure in flow path 364 acts on the first end surface 330 for urging the propulsion control valve to the right as shown in FIG. 3. When the fluid pressure in the flow path 364 is below the pre-selected threshold, the aft sequence valve 314 is closed such that the fluid pressure in flow path 364 cannot act on the first end surface 330. In addition, when the aft sequence valve 314 is closed, and the fluid in the portion of the flow path between the aft sequence valve 314 and the propulsion control valve 310 is vented to the annulus 40, thereby removing any remaining force acting on the first end surface 330. It will be understood that the forward sequence valve 316 preferably operates in the same manner as the aft sequence valve 314.

The aft and forward sequence valves 314, 316 used in combination with the propulsion control valve 310 significantly improve the efficiency of the tractor operation. In particular, the aft and forward sequence valves 314, 316 provide a reliable and constant pressure threshold in the flow paths 364, 366 that must be overcome in order to pilot the propulsion control valve 310. Because the aft and forward sequence valves 314, 316 provide a reliable pressure threshold, the fluid flow rates through the valve system may be increased substantially without having an adverse effect on the operation of the tractor. As a result, the gripper assemblies may be actuated more quickly, which in turn decreases the dwell time (i.e., the delay time between power strokes) and substantially increases the overall tractor speed through the borehole. Furthermore, due to the reliability of the tractor, the educational and skill requirements for service personnel are reduced, which thereby reduces operational costs.

Figure 6:
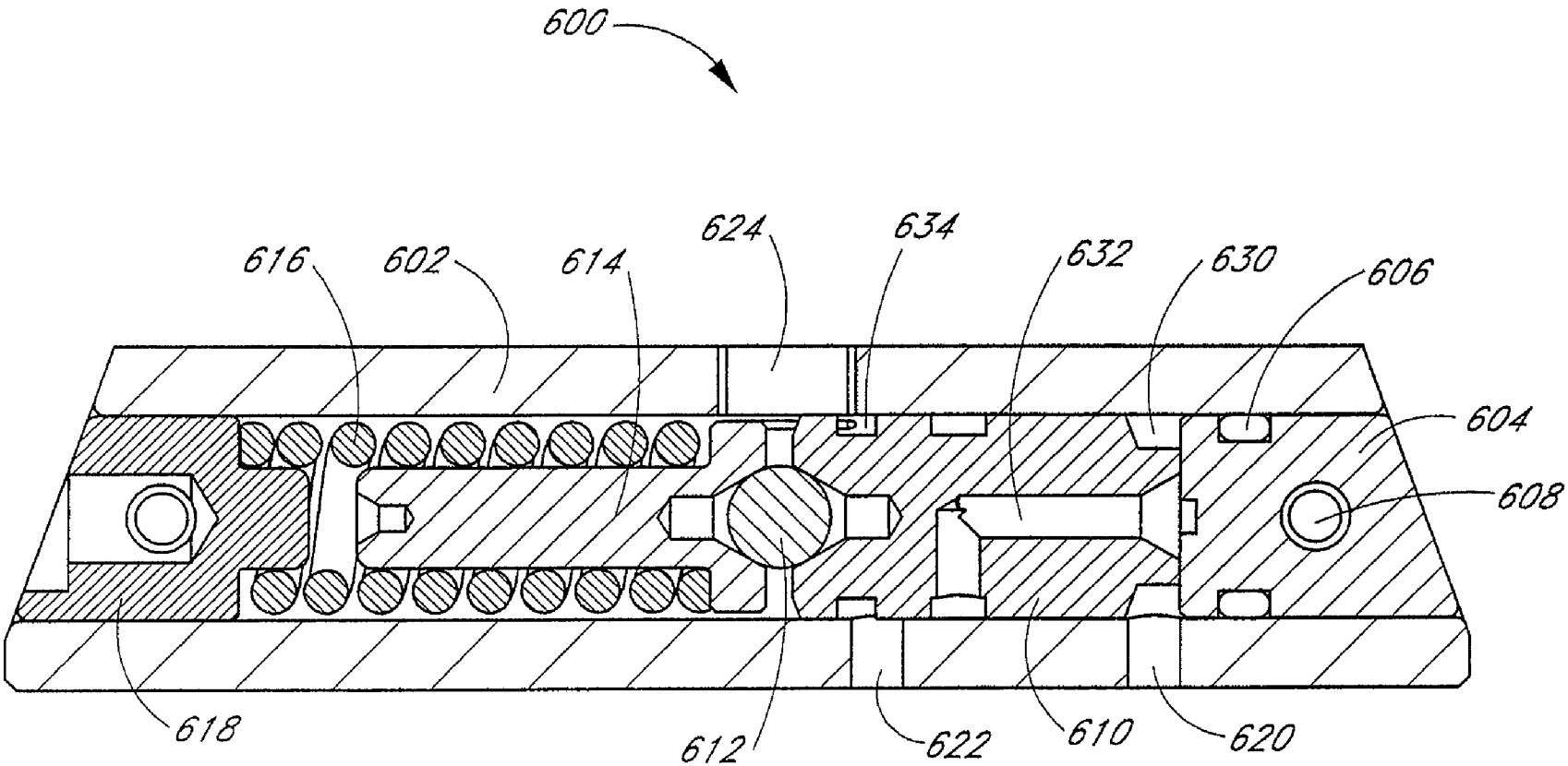
FIG. 6 is a longitudinal sectional view illustrating a preferred embodiment of a vent valve assembly.

With reference now to FIG. 6, the primary components 600 of one preferred embodiment of an aft sequence valve (see element 314 in FIG. 3) are shown in a longitudinal sectional view. The components 600 of the aft sequence valve are preferably identical to the components of the forward sequence valve and therefore only the components of the aft sequence valve will be described. The illustrated components 600 of the aft sequence valve generally comprises a body 602 formed with a hollow interior and a spool 610 slidably housed within the hollow interior. An inlet port 620, a working port 622 and an exhaust port 624 are provided through the body 602 for communication with the hollow interior. A bore 632 is formed through the spool 610. The slidable spool 610 is preferably coupled to a spring guide 614 via a ball 612. In one embodiment, the ball 612 is made of silicon-nitride. A spring 616 extends around the guide 614 and contacts a stop 618 at one end. A plug 604 at the other end of the body 602 provides a fluid tight seal. The plug 604 and stop 618 are preferably coupled to the body 602 via a pin or dowel 608.

During use, pressurized fluid (e.g., from fluid passage 364 as shown in FIG. 3) enters the inlet port 620 of the aft sequence valve. The fluid enters the annular region 630 located between the spool 610, the body 602 and the plug 604. The fluid pressure urges the spool 610 to move to the left. At the same time, the spring 616 provides a biasing force that urges the spool to the right. When the fluid pressure in the annular region 630 exceeds a pre-selected threshold (e.g., 900 psid), the spool 610 will move to the left a sufficient distance such that the bore 632 communicates with the working port 622. As a result, fluid may pass from the inlet port through the bore 632 and out through the working port 622 (e.g. for piloting the propulsion control valve 310 in FIG. 3). When the pressure is below the threshold, the spool 610 is located hardover to the right, as shown in FIG. 6. In this position, fluid may travel back through the working port 622, into the annular region 634 and out through the exhaust port 624 to the annulus. This feature allows fluid to vent to the annulus when the fluid in the flow path 364 or 366 (see FIG. 3) is not pressurized.

Pressure Reducing Valve

With reference again to FIG. 3, in a preferred embodiment, the outlet flow from the start/stop valve 308 along fluid path 354 passes through the pressure reducing valve 326 before entering the gripper control valve 312. The pressure reducing valve 326 is preferably a direct operating valve that limits the pressure of the operating fluid in the aft and forward gripper assemblies, and thus provide a means for preventing possible damage to the gripper assembly components.

When the pressure downstream of the pressure reducing valve 326 increases above a pre-selected threshold (e.g., 1400 psid), the pressure reducing valve closes to protect the gripper assemblies from becoming over-pressurized. Thus, the pressure reducing valve 326 imposes an upper limit on the pressure in the passage 356 and thereby prevents over-pressurization of the gripper assemblies by bleeding excess pressure to the annulus 40.

Gripper Control Valve

With continued reference to FIG. 3, the gripper control valve 312 directs fluid to either the aft gripper assembly or the forward gripper assembly. In the illustrated embodiment, the gripper control valve 312 is preferably a two-position, sliding-spool directional valve that functions in essentially the same manner as the propulsion control valve 310 described above. For additional details regarding preferred embodiments of the valves 310 and 312, see Applicant's U.S. Pat. No. 6,679,341, which is incorporated herein by reference.

The spool of the gripper control valve 312 has a first position (as shown in FIG. 3) in which the gripper control valve 312 provides a flow path 370 to the aft gripper assembly. When the spool of the valve 312 is in its first position, the valve 312 also provides a flow path 372 for the flow of fluid from the forward gripper assembly to the annulus 40. The spool of the gripper control valve 312 also has a second position, not shown in FIG. 3. In the second position, the gripper control valve 312 provides a flow path 372 to the forward gripper assembly. When the spool of the valve 312 is in its second position, the valve also provides a flow path 370 for the flow of fluid from the aft gripper assembly to the annulus 40.

The spool of the gripper control valve 312 has a first end surface 334 and a second end surface 336. The first end surface 334 is in fluid communication with the forward piston poppet valve 324 along flow path 380. The second end surface 336 is in fluid communication with the aft piston poppet valve 322 along flow path 382. The first and second end surfaces 334 and 336 are configured to receive respective fluid pressures from flow paths 380 and 382 that act on the spool of the valve. The first end surface 334 receives a pressure force from the outlet of the forward piston poppet valve 324 that tends to move the spool of the gripper control valve 312 toward its first position, as shown in FIG. 3. The second end surface 336 receives a pressure force from the outlet of the aft piston poppet valve 322 that tends to move the spool toward its second position, which would be shifted to the left in FIG. 3. The structure and function of preferred embodiments of the aft and forward poppet valves 322, 324 are described in more detail below.

Vent Valves

With continued reference to FIG. 3, an aft vent valve 318 is preferably provided along the fluid path 382 extending from the aft piston poppet valve 322 to the first end surface 336 of the gripper control valve 312. In addition, a forward vent valve 320 is preferably provided along the fluid path 380 extending from the forward piston poppet valve 324 to the second end surface 334 of the gripper control valve 312. Similar to the aft and forward sequence valves 314, 316 described above, the aft and forward vent valves 318, 320 each prevents fluid from passing through their respective fluid path unless the pressure fluid in the path exceeds a pre-selected threshold. As a result, the aft and forward vent valves provide for reliable shifting of the spool in the gripper control valve 312 and further improve the timing and efficiency of the valve system. When the pressure drops below the pre-selected threshold, the aft and forward vent valves 318, 320 allow the fluid in the flow paths between the vent valves and end surfaces to be vented to the annulus 40. In preferred embodiments, the structure of the aft and forward vent valves 318, 320 is substantially identical to the aft and forward sequence valves 314, 316 described above with reference to FIG. 6.

Preferred Configurations of Shaft Assemblies/Piston Poppet Valves

With reference again to FIG. 2, aft and forward shaft assemblies 118, 124 are coupled to the aft and forward ends of the control assembly 102. The aft and forward shaft assemblies 118, 124, along with the control assembly 102, form the body of the tractor 100. The aft gripper assembly 104 and aft propulsion cylinder 108 are slidably coupled to the aft shaft assembly 118. The forward gripper assembly 106 and forward propulsion cylinder 114 are slidably coupled to the forward shaft assembly 124.

Figures 7A, 7B:
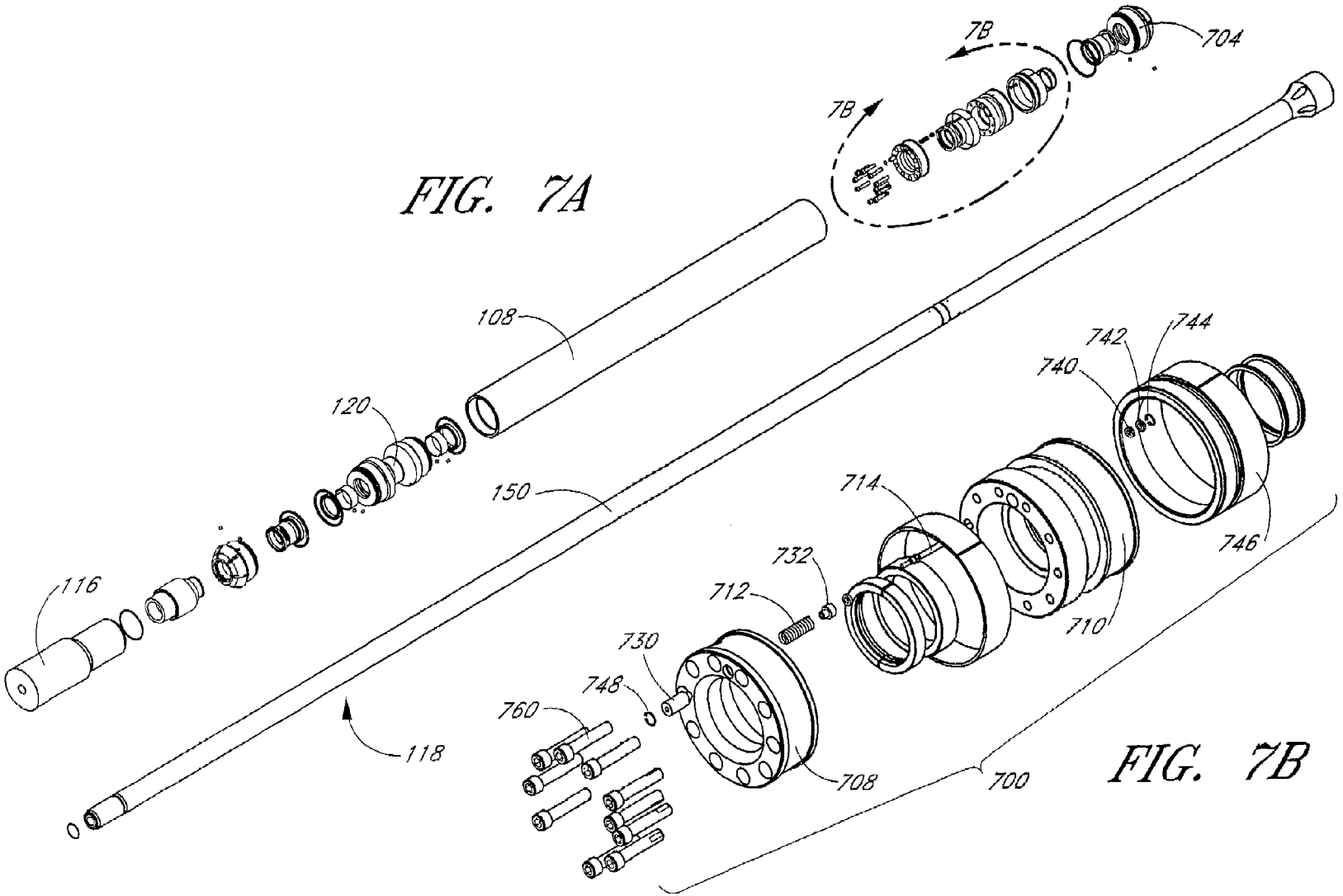
FIGS. 7A and 7B are exploded views of a shaft assembly for use with the tractor.

With reference now to FIG. 7A, for purposes of illustration, an exploded view of the aft shaft assembly 118 is shown in combination with the aft cylinder 108 and aft tool joint assembly 116. The aft shaft assembly 118 generally includes an elongate shaft 150 formed with a substantially cylindrical shape. In a preferred embodiment, the aft cylinder 108 is substantially tubular in shape and is slidably disposed over the shaft 150 such that an annular region is formed therebetween. The aft cylinder 108 is sealed at the aft end by the flex joint 120. The aft cylinder 108 is sealed at the forward end by a gland seal 704. The aft cylinder 108 is thus sealed at both ends and slidably houses the aft piston for providing the aft propulsion assembly. When fully assembled, a gripper assembly (not shown) is also slidably disposed over the shaft 150 and is preferably coupled to the flex joint 120 along the aft end.

With reference now to FIG. 7B, an enlarged view of the aft piston 700 is shown for purposes of illustration. The aft piston 700 is rigidly connected to the aft shaft 150 and includes the aft piston poppet valve (see element 322 of FIG. 3). The aft piston 700 slides within the aft cylinder 108 and separates the power chamber from the retract chamber.

Figure 8:
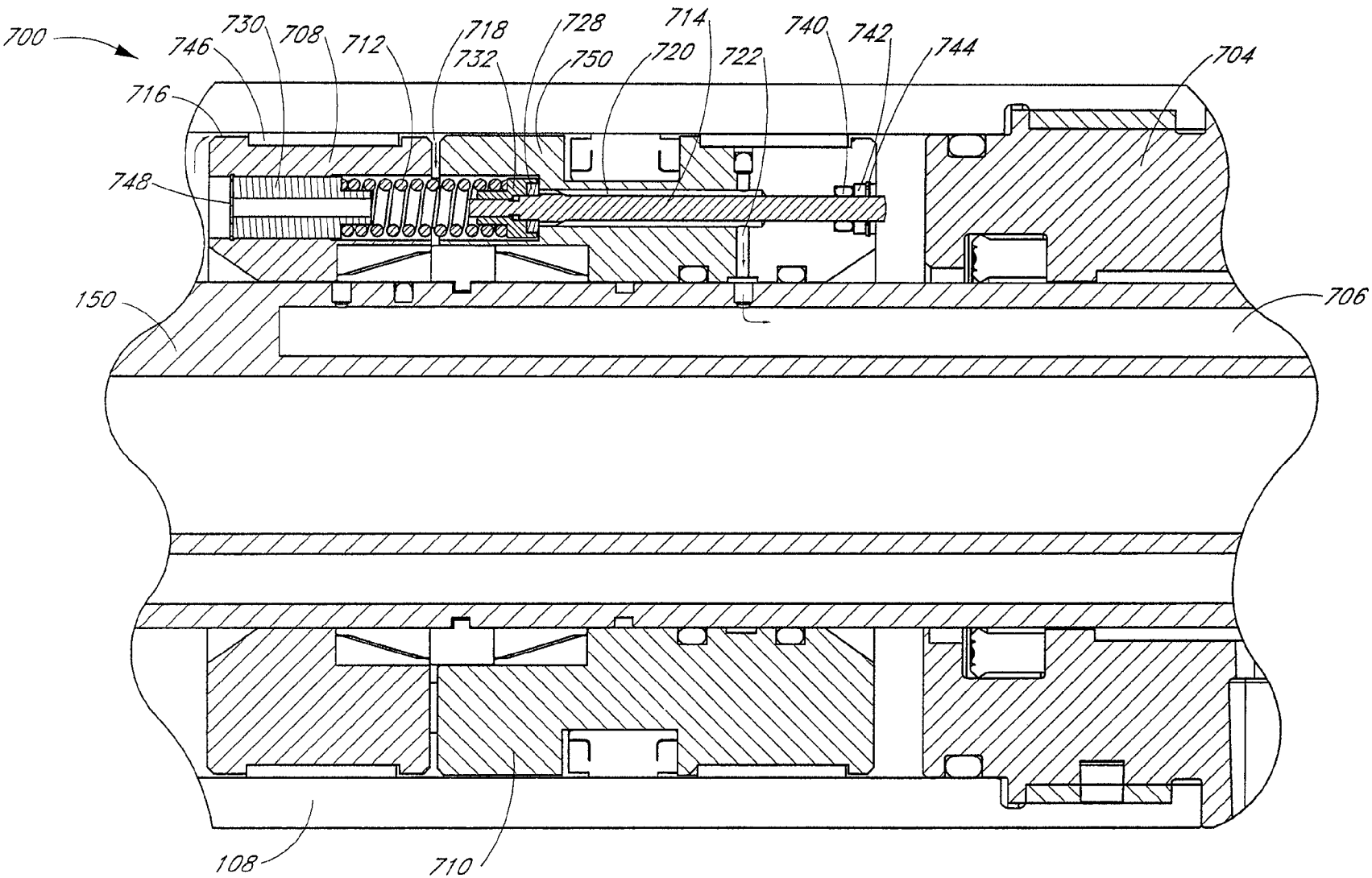
FIG. 8 is a longitudinal sectional view illustrating a preferred embodiment of a piston poppet valve integrated into a piston.

FIG. 8 is a longitudinal sectional view illustrating the aft piston 700, which includes the aft piston poppet valve (see element 322 of FIG. 3). With reference now to both FIG. 7B and FIG. 8, the aft piston 700 generally comprises a flange 708 and a hub 710. The flange 708 and hub 710 separate the power and retract chambers within the aft cylinder 108. The flange 708 is surrounded by a wear guide 746 and houses a seat 730. The seat 730 is maintained in place by an internal retaining ring 748 at the aft end. A spring 712 is adjacent the seat 730 and extends from the flange 708 into the hub 710. A stem 714 is coupled to the spring 712 and is slidably housed within the hub 710. A portion of the stem 714 extends from an end surface of the hub for contacting the seal gland 704. The protruding end of the stem 714 is guided by a stem guide 742, which is supported by an o-ring 740 and a retaining ring 744.

The protruding end of the poppet valve stem 714 is located for contacting the seal gland 704, or other inner wall, as the piston reaches the end of the power stroke. As the valve stem 714 contacts the seal gland 704, the valve stem slides axially with respect to the hub 710. As the stem slides, a seal washer 728 and a valve cap 732 are displaced from a valve seat 750 of the piston hub 710. As a result, pressurized fluid from the power chamber of the cylinder flows through a gap 716 between the outer diameter of the piston flange 708 and the inner diameter of the cylinder 108. The fluid continues to flow through a gap 718 located between the flange 708 and the hub 710, around the valve stem 714, and through the piston hub 710. The fluid then flows in a radial direction through a port 722 and then into the pilot passage 716. The fluid in the pilot passage 716 may then be ported to the control assembly for controlling the position of the gripper control valve, as schematically illustrated and described above with respect to FIG. 3.

With continued reference to FIGS. 7B and 8, as the piston 700 moves away from the seal gland 704, the valve spring 712 applies a biasing force that reseats the seal washer 728 onto the valve seat 750 of the piston hub 708. As a result, the pilot passage 706 becomes sealed from the fluid pressure on both sides of the piston. In an important aspect of the above-described embodiment, the presence of pressurized fluid in the pilot passage 706 provides a means for accurately detecting and indicating the completion of the aft power stroke. This provides a significant advantage over pressure-responsive valves that may shift prematurely due to pressure fluctuations.

As illustrated, the mechanically actuated valve is desirably provided as a piston poppet valve. When used with preferred embodiments of the tractor, piston poppet valves have certain advantages over other mechanically actuated valves, such as, for example, reliability, small size and reliability. However, in alternative embodiments, other types of mechanically actuated valves may also be used for detecting the completion of a power stroke. For example, a diaphragm valve may be used to signal the completion of a power stroke. The diaphragm valve is mechanically actuated in a manner similar to that described above for the poppet valve to detect the completion of a power stroke. In another preferred embodiment, a shear valve may be used to signal the completion of the piston stroke. The shear valve includes a floating seal that slides to open or close an orifice. The shear valve may be mechanically actuated in a manner similar to that described above for the poppet valve to detect the completion of a power stroke. In addition, it will be appreciated that a piston poppet valves (or other mechanically actuated valve) may be located in a variety of different locations while still providing the ability to detect the completion of the piston stroke. In one alternative configuration, the valve may be integrated into the cylinder, rather than into the piston. Still further, in embodiments of a tractor that is reversible in direction, piston poppet valves, or other mechanically actuated valves, may be provided on both sides of a piston for detecting the completion of a power stroke in either direction.

Preferred Configuration of Control Assembly

Figure 9:
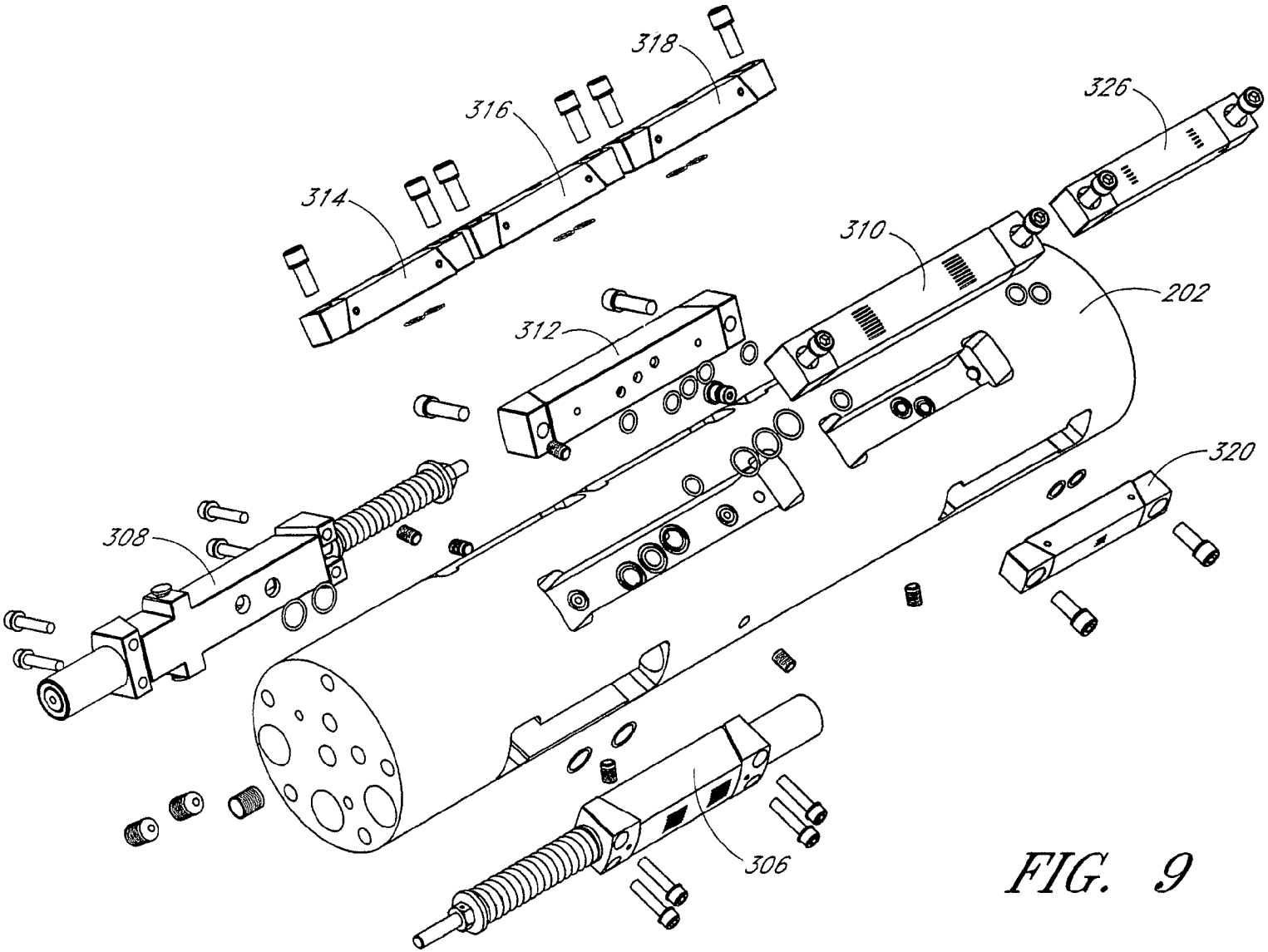
FIG. 9 is an exploded view of the central housing of the valve control assembly.
Figure 10:
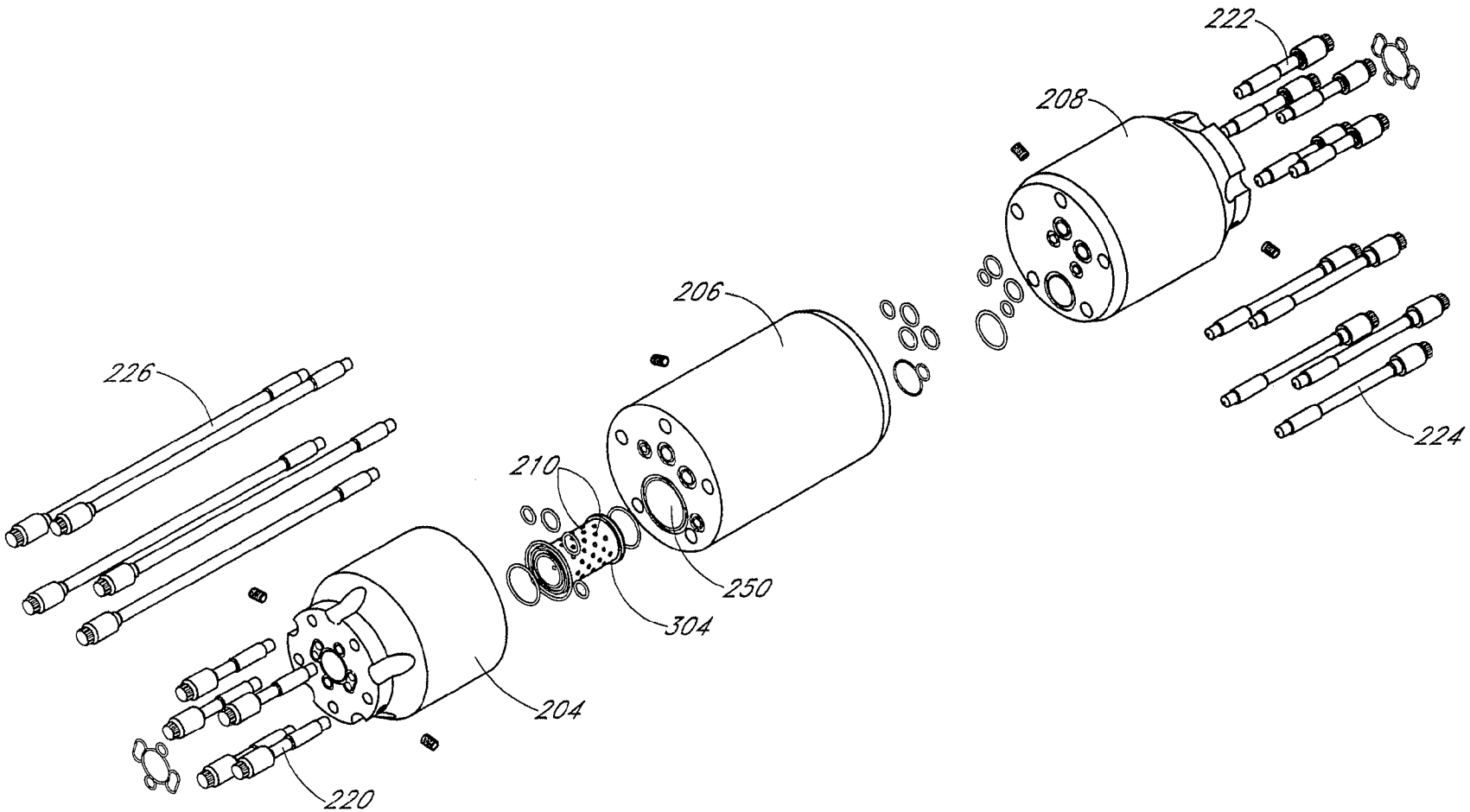
FIG. 10 is an exploded view of the transition regions located at the aft and forward ends of the valve control assembly.

With reference now to FIGS. 9 and 10, a preferred embodiment of the control assembly (see element 102 of FIG. 2) is shown partially disassembled. FIG. 9 illustrates a control housing 202, which forms the central portion of the control assembly. FIG. 10 illustrates the aft transition housing 204, the filter housing 206 and the forward transition housing 206. Connectors 220 are provided for coupling the aft transition housing 204 to the aft shaft and connectors 222 are provided for coupling the forward transition housing 206 to the forward shaft. Connectors 226 couple the aft transition housing 204 and the filter housing 206 to the control assembly 202. Connectors 224 couple the forward transition housing 208 to the control assembly 202.

With reference again to FIG. 9, one preferred embodiment of the control housing 202 houses the propulsion control valve 310, the gripper control valve 312, the pressure relief valve 306, the pressure reducing valve 326, the start/stop valve 308, the aft sequence valve 314, the forward sequence valve 316, the aft vent valves 318, and the forward vent valve 320. Each of the valves preferably comprises a spool housed within an elongate valve housing defining a spool passage. In one configuration, the valves are positioned within recesses along the outer surface of the control housing 202.

The propulsion control valve 310, gripper control valve 312, pressure reducing valve 326, vent valves 318, 320 and sequence valves 314, 316 are preferably all configured in a similar manner for ease of manufacture. In particular, each of the valves is provided in an elongate housing that fits within a recess along the outer surface of the control assembly 202. The valve housings are each attached to the body of the control assembly via two bolts or other appropriate attachment means. The pressure relief valve 306 and the start/stop valve 308 are preferably configured in a similar manner. In one embodiment, the pressure relief valve 306 and start/stop valve 308 are both attached to the body of the control assembly via four bolts or other appropriate means for attachment.

The central housing 202 includes numerous internal fluid passages for the controlled flow of operating fluid to the downhole equipment (see element 32 of FIG. 1), between the valves, to the gripper assemblies, and to the propulsion cylinders. In one preferred embodiment, the fluid passages are configured to create the valve system shown schematically in FIG. 3. Some of the fluid passages extend to corresponding fluid passages in the end surfaces of the transition housings 204, 206 and 208. In a preferred embodiment, the primary internal passage is shifted off center to maximize available space for the various valves and internal fluid passages.

An internal passage 250 extends through the aft transition housing 204, the filter housing 206 and the forward transition housing 208. The internal passage also extends through the aft and forward shafts and the control housing 202 such that pressurized fluid from the supply line may pass through the tractor body to the downhole assembly. As shown in FIG. 10, the filter housing 206 houses the filter/diffuser 304. The filter/diffuser 304 is generally cylindrical and has a plurality of side holes 210 for allowing filtered fluid to pass from the internal passage to the start/stop valve 308 (as shown schematically in FIG. 3). In one preferred embodiment, the side holes 210 are angled so that the fluid passing forward through the filter/diffuser 304 must turn somewhat aftward to pass through. This prevents larger particles within the operating fluid from entering the start-stop valve 308, as it is more difficult for the larger particles to overcome forward momentum and flow through the side holes. Those of ordinary skill in the art will understand that any of a variety of different types of filters can be used instead of the illustrated diffuser 304.

Tractor Operation

With reference again to FIG. 3, pressurized fluid is provided to the control assembly from a supply source (e.g., on the surface) via a supply line 302. The supply line 302 preferably extends through an internal passage in the elongate tractor body for providing pressurized fluid to the downhole equipment. When the pressure in the supply line 302 increases above a pre-selected threshold (e.g., 900 psi), the start-stop valve 308 opens if the index is in the on position. If the index is in the off position, a pressure cycle (e.g., dropping the pressure to 0 psi and then back up to 900 psi) will change the drum index to the on position. When the start/stop valve 308 is open, the supply flow takes parallel paths to the pressure relief valve 306, the propulsion control valve 310 and the pressure reducing valve 326.

As discussed above, it has been found that the pressure of the operating fluid in the supply line 302 can fluctuate significantly during movement of the tractor and/or operation of the downhole equipment. Under certain circumstances, the pressure fluctuations can be substantial and can damage internal components and render other hydraulically coupled tools inoperable or incompatible. Accordingly, the pressure relief valve 306 is provided for regulating the fluid pressure in the supply line 302 (i.e., in the internal passage), and thus in the valve system located within the control assembly. In an important feature, the pressure of the fluid flowing to both the control assembly and the downhole equipment is desirably regulated. This feature improves the efficiency of the bottom hole assemblies and extends the life of the hardware components. In addition, the pressure relief valve 306 is off when the start-stop valve 308 is closed. This feature advantageously allows high-pressure (i.e., non-regulated) fluid to be selectively directed to the downhole equipment when desired.

After passing through the start-stop valve 308, the pressurized fluid flows along path 354 to the pressure reduction valve 326 and then on to the gripper control valve 312. In the illustrated configuration, the gripper control valve 312 is shifted to the right such that the fluid in flow path 370 is pressurized and the fluid in flow path 372 is depressurized. As a result, the aft gripper assembly begins expanding in a radial direction for engagement with the inner surface of the borehole and the forward gripper assembly contracts radially for disengagement from the inner surface of the borehole. When the aft gripper assembly become fully actuated, the fluid flow through flow path 370 stops and, as a result, the fluid pressure increases substantially (i.e., to the system pressure) in flow paths 370 and 364. During this time, the pressure reducing valve 326 protects the aft gripper assembly from damage due to over-pressurization.

When the aft gripper assembly has becomes sufficiently fully engaged, the pressure in the flow path 364 exceeds the preset threshold (e.g., 900 psid) of the aft sequence valve 314. As a result, fluid flows through the aft sequence valve 314 and acts on the first end surface 330 of the propulsion control valve 310, thereby causing the spool to shift to the right (as shown in FIG. 3). Accordingly, the valve system is configured such that the gripper assembly becomes fully actuated before the propulsion control valve initiates a power stroke.

In this position, pressurized fluid passes through the propulsion control valve 310 to the power chamber of the aft cylinder and to the reset chamber of the forward cylinder. As fluid enters the power chamber of the aft cylinder, the pressurized fluid pushes on the aft piston and thereby causes the tractor body to advance forward through the borehole relative to the aft gripper assembly (which is anchored to the inner surface). Movement of this type is generally referred to herein as a power stroke. At the same time, as fluid enters the reset chamber of the forward cylinder, the pressurized fluid pushes the forward cylinder and forward gripper assembly forward relative to the tractor body. This movement resets the position of the forward gripper assembly prepares the forward cylinder for a subsequent power stroke. Movement of this type is generally referred to herein as a reset stroke. Because the resistance to a reset stroke is relatively small, the reset stroke is typically completed before the power stroke is completed.

As the tractor body reaches the end of the power stroke with respect to the aft cylinder, the aft piston poppet valve 322 is actuated. This occurs when a stem on the aft piston poppet valve comes into contact with a portion of the aft cylinder such that the stem is mechanically depressed. When the stem is depressed, pressurized fluid enters a flow passage 382. When the pressure in flow path 382 becomes sufficiently large, the aft vent valve 318 opens to allow pressurized fluid to pass through to the second end surface 336 of the gripper control valve 312. The fluid pressure causes the spool in the gripper control valve 312 to shift to the left (i.e., to the position not shown in FIG. 3).

After the gripper control valve 312 switches its position, the fluid within the flow path 370 becomes depressurized and the fluid within the flow paths 366 and 372 becomes pressurized. When the pressure in flow path 366 becomes sufficiently large, the forward sequence valve 316 opens such that pressurized fluid acts on second end surface 332 of the propulsion control valve 310 and causes the spool to shift to the left (i.e., to the position not shown in FIG. 3). The pressure in flow path 366 becomes sufficiently large to open the forward sequence valve 316 after the forward gripper assembly comes into contact with the inner surface of the borehole and is therefore prevented from expanding any further. When the forward gripper assembly stops expanding, the flow to the forward gripper assembly through flow path 372 is stopped, thereby producing an increase in fluid pressure.

Due to the shifting of the spool in the propulsion control valve 310, pressurized fluid within the flow path 354 flows through the propulsion control valve 310 and into the forward chamber of the forward cylinder and the aft chamber of the aft cylinder. Simultaneously, fluid within the aft chamber of the forward cylinder, as well as fluid within the forward chamber of the aft cylinder, flows back through the propulsion control valve 310 into the annulus 40. This causes the forward piston, and thus the entire tractor body, to be thrust forward through the borehole with respect to the actuated forward gripper assembly in another power stroke. Simultaneously, the aft cylinder is thrust forward with respect to the piston and the tractor body in a reset stroke.

As the tractor body reaches the end of the power stroke with respect to the forward cylinder, the forward piston poppet valve 324 is actuated. This occurs when a stem on the forward piston poppet valve comes into contact with a portion of the forward cylinder such that the stem on the forward piston poppet valve is mechanically depressed. When the stem is depressed, pressurized fluid enters flow passage 380. When the pressure in flow path 380 is sufficiently large to overcome the pre-selected threshold pressure, the forward vent valve 320 opens to allow pressurized fluid to pass through to the first end surface 334 of the gripper control valve 312. The fluid pressure causes the spool in the gripper control valve 312 to shift back to the right (i.e., to the position shown in FIG. 3). At this point, all of the valves have returned back to their original positions (i.e., to the positions generally shown in FIG. 3). Thus, the above describes a complete cycle of operation of the valve system during forward motion.

Note that during forward or aft (i.e., backward) motion, the gripper assemblies preferably shuttle between two extreme positions. First, the gripper assemblies move as far apart as possible toward opposite ends of the tractor. Second, the gripper assemblies move as close together as possible (with the propulsion cylinders and control assembly between them). During most of the operation of the tractor, one gripper assembly is in a power stroke while the other is in a reset stroke. When they switch directions they also switch gripper action. Hence, the tractor continually moves in one longitudinal direction.

A significant advantage of the preferred configuration of the valve system is that the tractor body is assured of completing its forward advancement (i.e., power stroke) before the gripper assemblies are switched between their actuated and retracted positions. As described above, the reliability and efficiency of the tractor movement may be improved by the incorporation of the mechanically-actuated valves (e.g., piston poppet valve) into the valve system. The piston poppet valves provide a mechanism to detect and signal the completion of a power stroke. In addition, in a preferred configuration, the outlet from the gripper control valve 312 is used to pilot the propulsion control valve 310. As a result, the system ensures that the gripper is fully actuated before a power stroke commences.

In one preferred embodiment, the flow rate of operating fluid into the valve system in the control assembly can be up to about 23 gallons per minute. Typically, large positive displacement pumps are utilized at the ground surface to pump fluid down the coiled tubing and through the internal passage of the tractor. Such pumps usually supply a system flow rate of up to about 120 gpm. In one typical mode of operation, the valve system receives approximately 20% of the fluid passing through the internal passage of the tractor body. In other modes of operation, the valve system receives approximately 5%, 10%, 15% or 25% of the fluid passing through the internal passage.

In a preferred embodiment of the tractor wherein the valve system is all-hydraulic, the tractor's maximum speed may be greater than that of an electrically controlled tractor. The valve system does not include electrical conductors and other electrical elements, which allows for larger internal fluid passages, greater flow rates, and improved power density. The faster maximum speed of the tractor results in lower operational costs, especially for intervention applications. In one preferred embodiment of the invention, the tractor is capable of moving at speeds greater than or equal to 1350 feet per hour.

Reversible Tractor

Figure 11:
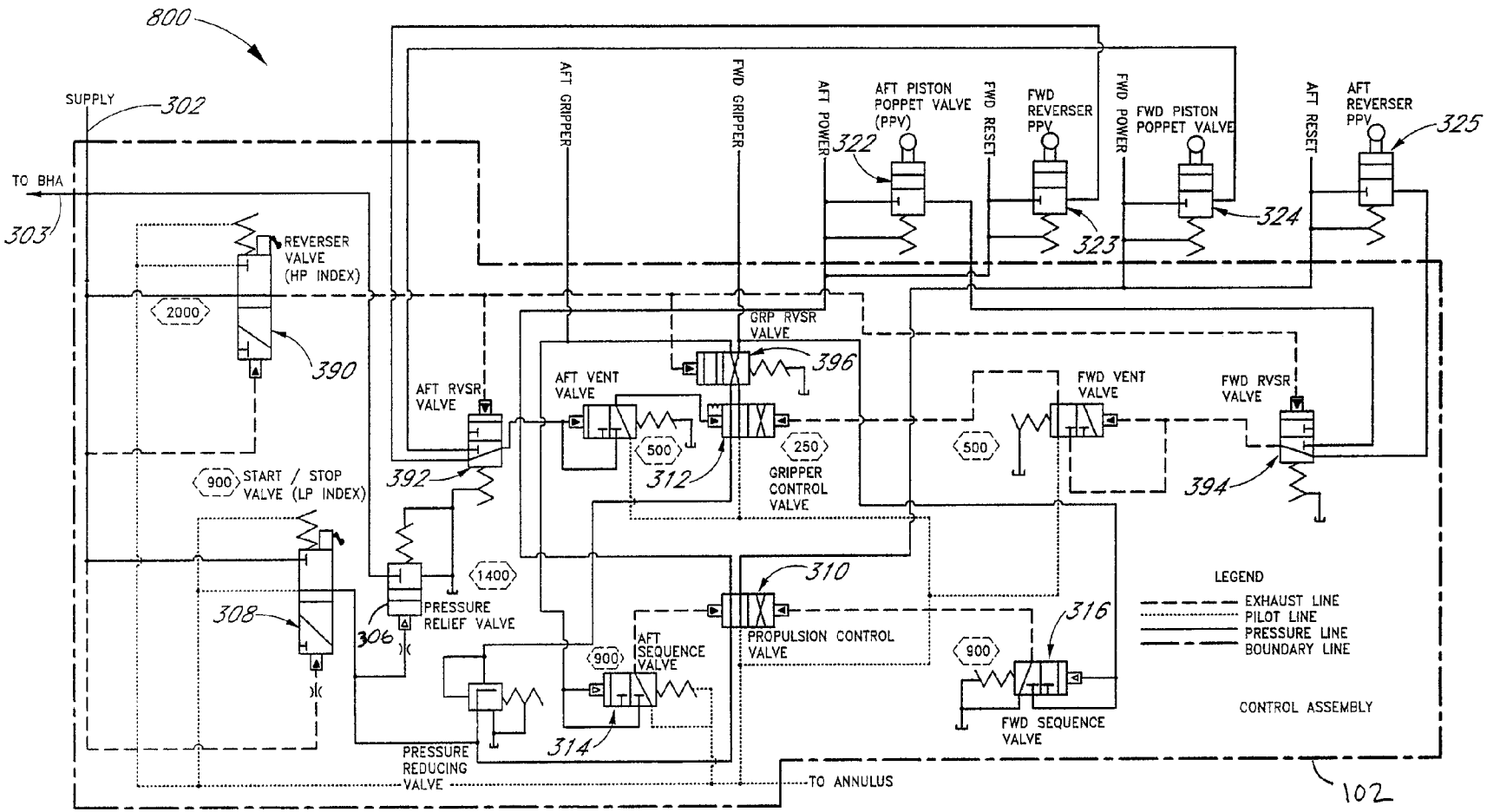
FIG. 11 is a schematic diagram illustrating another preferred embodiment of a valve control assembly for use with the reversible tractor.

In another preferred embodiment, the tractor may be capable of movement through a passage in both forward and aft directions. With reference now to FIG. 11, one embodiment of an improved valve system 800 is illustrated for use with a reversible tractor. Similar to the valve system described above with reference to FIG. 3, the improved valve system 800 illustrated in FIG. 11 receives pressurized fluid from a supply line 302. The pressurized fluid passes through a start-stop valve 308 for providing hydraulic power to the tractor control assembly 102. To provide the tractor operator with the ability to selectively reverse directions, the valve system 800 in the control assembly further comprises a main reverser valve 390, an aft reverser valve 392, a forward reverser valve 394, and a gripper reverser valve 396. The main reverser valve 390 is piloted by fluid pressure in the supply line 302. The main reverser valve 390, in turn, pilots the aft reverser valve 392, the forward reverser valve 394 and the gripper reverser valve 396.

Similar to the embodiment described above with respect to FIG. 3, the improved valve system 800 for use with a reversible tractor preferably comprises an aft piston poppet valve 322, and a forward piston poppet valve 324. The aft and forward piston poppet valves 322, 324 are adapted for detecting the completion of the piston stroke during forward advancement through the passage. In addition, the improved valve system shown in FIG. 11 comprises a forward reverser piston poppet valve 323, and an aft reverser piston poppet valve 325 for detecting completion of the piston stroke during aft movement through the passage. Therefore, as shown in FIG. 11, the improved valve system 800 is provided with two piston poppet valves on both the forward and aft pistons. As a result, the tractor is capable of providing accurate and efficient valve sequencing during movement in either the forward or aft direction. Because each piston includes two piston poppet valves, two independent pilot passages are preferably provided in the wall of the shaft for each piston.

During use, when the main reverser valve 390 is in the closed position (as shown in FIG. 11), no fluid passes through the main reverser valve and the valve system 800 operates in a manner similar to the manner described above with respect to FIG. 3. However, when the pressure in the supply line 302 is increased above a pre-selected threshold (e.g., 2000 psi), the main reverser valve 390 is indexed to the open position. As a result, the pressurized fluid in the supply line 302 passes through the main reverser valve 390 to the aft reverser valve 392, the forward reverser valve 394, and the gripper reverser valve 396. The fluid pressure causes the aft reverser valve 392, the forward reverser valve 394, and the gripper reverser valve 396 to change positions, thereby altering the sequencing of the valve operation. In particular, the aft and forward reverser valves 392, 394 allow the forward reverser piston poppet valve 323 and aft reverser piston poppet valve 325 to pilot the aft and forward vent valves during aft movement through the passage. Furthermore, the gripper reverser valve 396 changes the flow path from the gripper control valve 312 such that the desired gripper assembly is actuated before initiation of a power stroke.

In preferred alternative configurations, the improved valve system illustrated in FIG. 11 may also include a pressure relief valve 306 and aft and forward sequence valves 314, 316, as generally described above with reference to FIG. 3. Additional details of a tractor having the ability to reverse directions may be found in Applicant's U.S. Pat. No. 6,679,341, which is incorporated herein by reference.

Gripper Assemblies

Preferred embodiments of the tractor described herein may be used with a wide variety of different gripper assemblies. However, in preferred embodiments, the gripper assemblies 104 and 106 are embodied as a plurality of toes that are radially expandable for engaging the inner surface of the borehole. FIGS. 12-19 illustrate various preferred configurations of preferred gripper assemblies adapted for use with a tractor. Additional details can be found in Applicant's U.S. Pat. No. 6,715,559. In a preferred embodiment, the gripper assemblies 104 and 106 are substantially identical. Thus, the gripper assembly configurations shown in FIGS. 12-19 may be considered to describe both aft and forward gripper assemblies 104 and 106.

Figure 12:
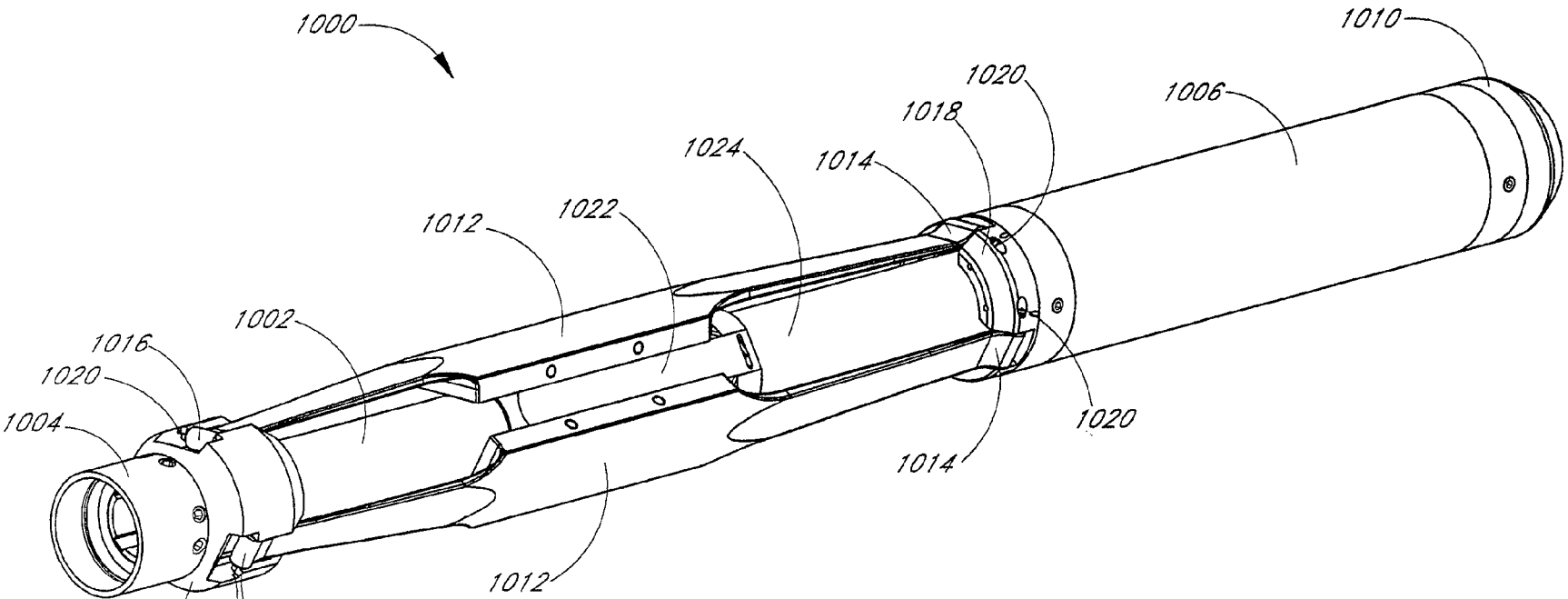
FIG. 12 is a perspective view of a gripper assembly having rollers secured to its toes, shown in a retracted or non-gripping position.

FIG. 12 shows one preferred embodiment of a gripper assembly 1000. The illustrated gripper assembly includes an elongated generally tubular mandrel 1002 configured to slide longitudinally along a length of the tractor 50. Preferably, the interior surface of the mandrel 1002 has a splined interface (e.g., tongue and groove configuration) with the exterior surface of the shaft, so that the mandrel 1002 is free to slide longitudinally yet is prevented from rotating with respect to the shaft. In another embodiment, splines are not included. Fixed mandrel caps 1004 and 1010 are connected to the forward and aft ends of the mandrel 1002, respectively. On the forward end of the mandrel 1002, near the mandrel cap 1004, a sliding toe support 1006 is longitudinally slidably engaged on the mandrel 1002. Preferably, the sliding toe support 1006 is prevented from rotating with respect to the mandrel 1002, such as by a splined interaction therebetween. On the aft end of the mandrel 1002, a cylinder 1008 is positioned next to the mandrel cap 1010 and concentrically encloses the mandrel so as to form an annular space therebetween. As shown in FIG. 12, this annular space contains a piston 1038, an aft portion of a piston rod 1024, a spring 1044, and fluid seals, for reasons that will become apparent.

The cylinder 1008 is fixed with respect to the mandrel 1002. A toe support 1018 is fixed onto the forward end of the cylinder 1008. A plurality of gripper portions 1012 are secured onto the gripper assembly 1000. In the illustrated embodiment the gripper portions comprise flexible toes or beams 1012. The toes 1012 have ends 1014 pivotally or hingedly secured to the fixed toe support 1018 and ends 1016 pivotally or hingedly secured to the sliding toe support 1006. As used herein, "pivotally" or "hingedly" describes a connection that permits rotation, such as by an axle, pin, or hinge. The ends of the toes 1012 are preferably engaged on axles, rods, or pins secured to the toe supports.

Those of skill in the art will understand that any number of toes 1012 may be provided. As more toes are provided, the maximum radial load that can be transmitted to the borehole surface is increased. This improves the gripping power of the gripper assembly 1000, and therefore permits greater radial thrust and drilling power of the tractor. However, it is preferred to have three toes 1012 for more reliable gripping of the gripper assembly 1000 onto the inner surface of a borehole. For example, a four-toed embodiment could result in only two toes making contact with the borehole surface in oval-shaped holes. Additionally, as the number of toes increases, so does the potential for synchronization and alignment problems of the toes. In addition, at least three toes 1012 are preferred, to substantially prevent the potential for rotation of the tractor about a transverse axis, i.e., one that is generally perpendicular to the longitudinal axis of the tractor body. For example, the three-bar linkage gripper described above has only two linkages. Even when both linkages are actuated, the tractor body can rotate about the axis defined by the two contact points of the linkages with the borehole surface. A three-toe embodiment of the present invention substantially prevents such rotation. Further, gripper assemblies having at least three toes 1012 are more capable of traversing underground voids in a borehole.

A driver or slider element 1022 is slidably engaged on the mandrel 1002 and is longitudinally positioned generally at about a longitudinal central region of the toes 1012. The slider element 1022 is positioned radially inward of the toes 1012, for reasons that will become apparent. A tubular piston rod 1024 is slidably engaged on the mandrel 1002 and connected to the aft end of the slider element 1022. The piston rod 1024 is partially enclosed by the cylinder 1008. The slider element 1022 and the piston rod 1024 are preferably prevented from rotating with respect to the mandrel 1002, such as by a splined interface between such elements and the mandrel.

Figure 13:
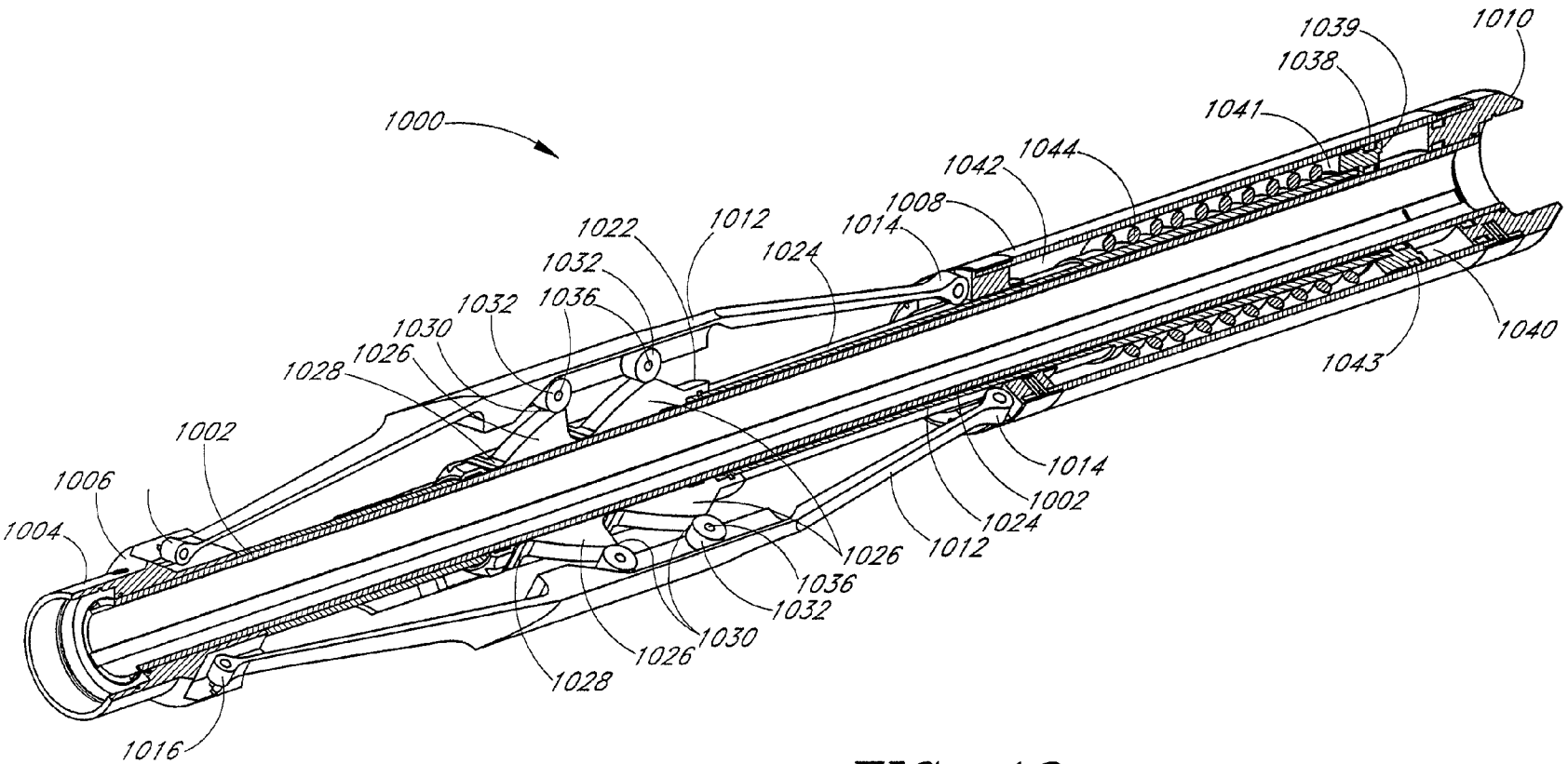
FIG. 13 is a longitudinal cross-sectional view of a gripper assembly having rollers secured to its toes, shown in an actuated or gripping position.
Figure 14:
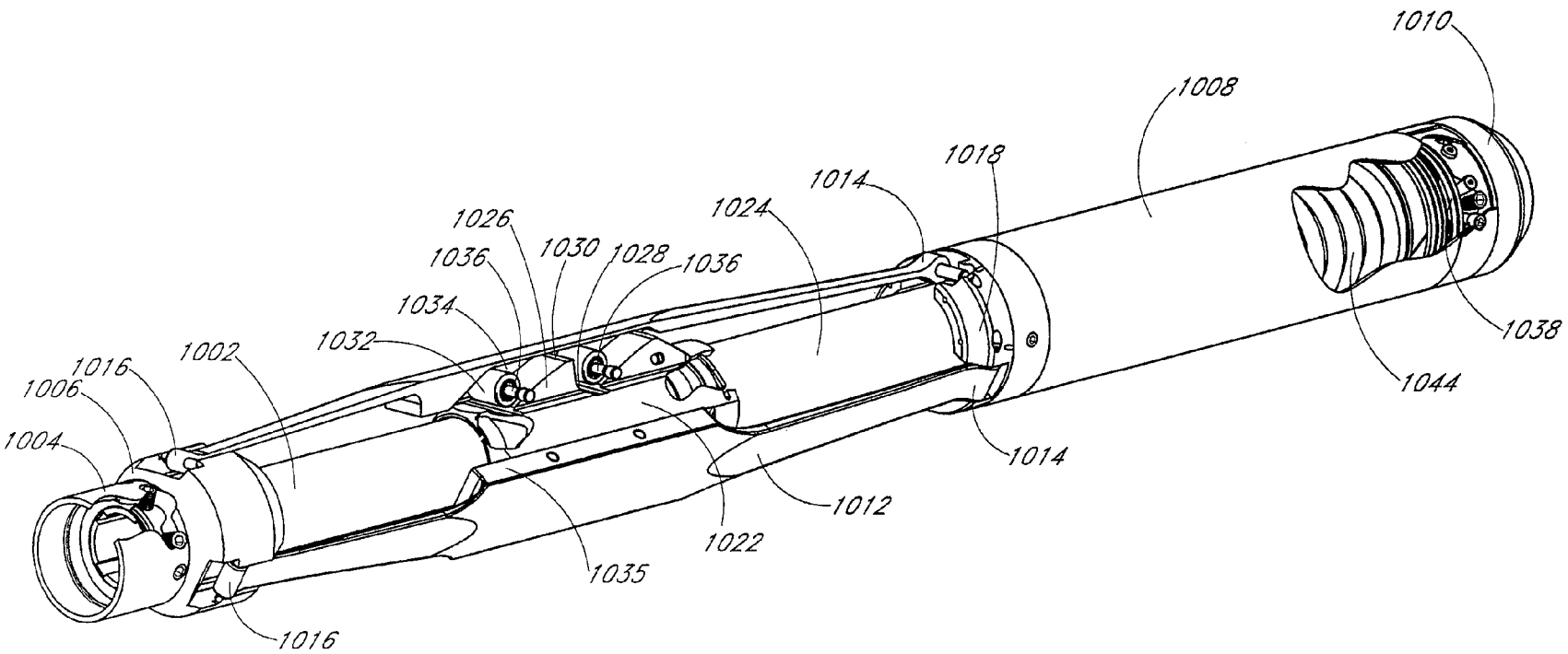
FIG. 14 is a perspective partial cut-away view of the gripper assembly of FIG. 12.
Figure 15:
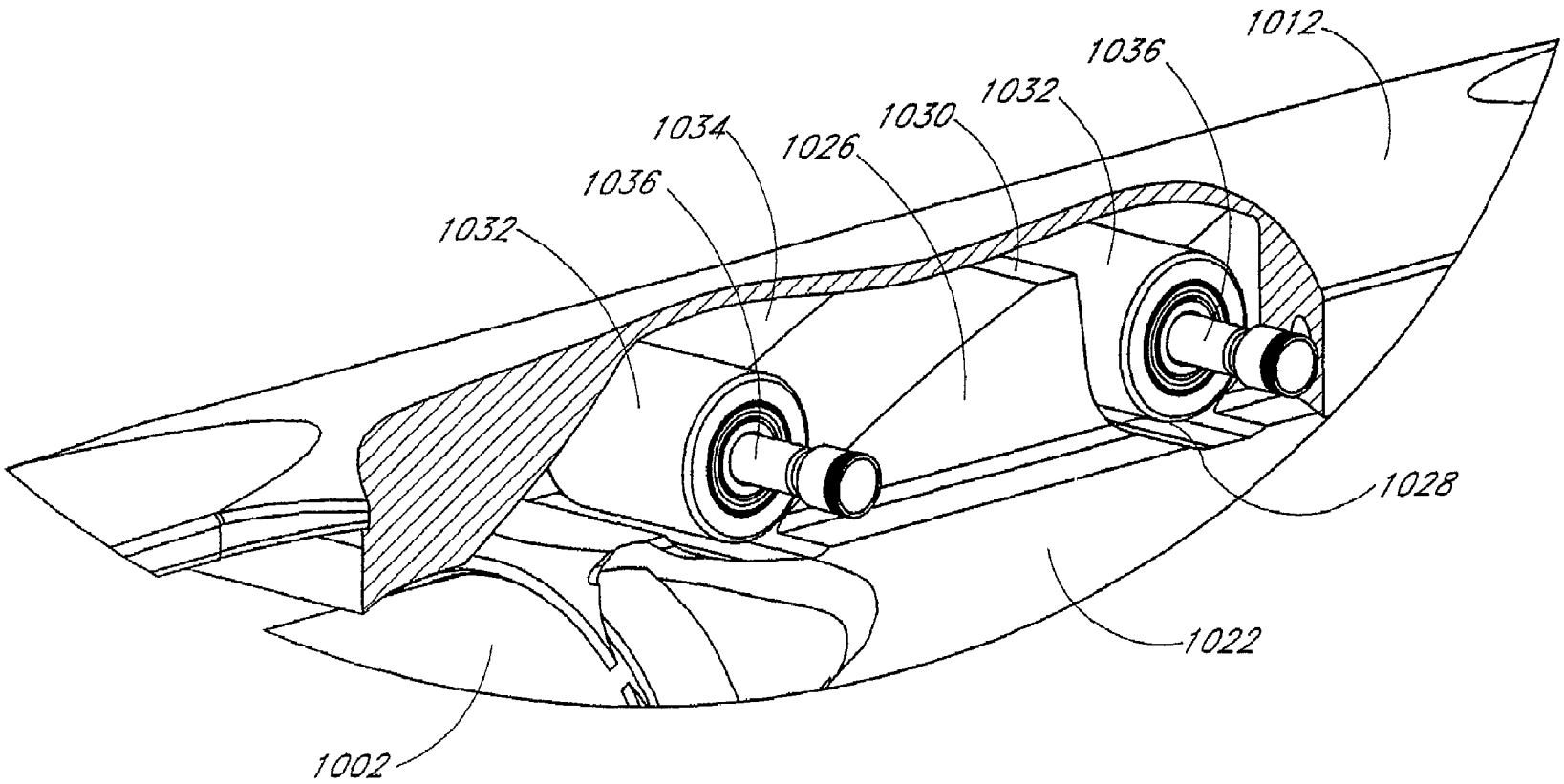
FIG. 15 is an exploded view of one set of rollers for a toe of the gripper assembly of FIG. 14.

FIG. 13 shows a longitudinal cross-section of a gripper assembly 1000. FIGS. 14 and 15 show a gripper assembly 1000 in a partial cut-away view. As seen in the figures, the slider element 1022 includes a multiplicity of wedges or ramps 1026. Each ramp 1026 slopes between an inner radial level 1028 and an outer radial level 1030, the inner level 1028 being radially closer to the surface of the mandrel 1002 than the outer level 1030. Desirably, the slider element 1022 includes at least one ramp 1026 for each toe 1012. Of course, the slider element 1022 may include any number of ramps 1026 for each toe 1012. In the illustrated embodiments, the slider element 1022 includes two ramps 1026 for each toe 1012. As more ramps 1026 are provided for each toe, the amount of force that each ramp must transmit is reduced, producing a longer fatigue life of the ramps. Also, the provision of additional ramps results in more uniform radial displacement of the toes 1012, as well as radial displacement of a relatively longer length of the toes 1012, both resulting in better overall gripping onto the borehole surface.

In a preferred embodiment, two ramps 1026 are spaced apart generally by the length of the central region 1048 of each toe 1012. In this embodiment, when the gripper assembly is actuated to grip onto a borehole surface, the central regions 1048 of the toes 1012 have a greater tendency to remain generally linear. This results in a greater surface area of contact between the toes and the borehole surface, for better overall gripping. Also, a more uniform load is distributed to the toes to facilitate better gripping. With more than two ramps, there is a greater proclivity for uneven load distribution as a result of manufacturing variations in the radial dimensions of the ramps 1026, which can result in premature fatigue failure.

Each toe 1012 is provided with a driver interaction element on the central region of the toe. The driver interaction element interacts with the driver or slider element 1022 to vary the radial position of the central region 1048 of the toe 1012. Preferably, the driver and driver interaction element are configured to interact substantially without production of sliding friction therebetween. In the illustrated embodiments, the driver interaction element comprises one or more rollers 1032 that are rotatably secured on the toes 1012 and configured to roll upon the inclined surfaces of the ramps 1026. Preferably, there is one roller 1032 for every ramp 1026 on the slider element 1022. In the illustrated embodiments, the rollers 1032 of each toe 1012 are positioned within a recess 1034 on the radially interior surface of the toe, the recess 1034 extending longitudinally and being sized to receive the ramps 1026. The rollers 1032 rotate on axles 1036 that extend transversely within the recess 1034. The ends of the axles 1036 are secured within holes in the sidewalls 1035 that define the recess 1034.

The piston rod 1024 connects the slider element 1022 to a piston 1038 enclosed within the cylinder 1008. The piston 1038 has a generally tubular shape. The piston 1038 has an aft or actuation side 1039 and a forward or retraction side 1041. The piston rod 1024 and the piston 1038 are longitudinally slidably engaged on the mandrel 1002. The forward end of the piston rod 1024 is attached to the slider element 1022. The aft end of the piston rod 1024 is attached to the retraction side 1041 of the piston 1038. The piston 1038 fluidly divides the annular space between the mandrel 1002 and the cylinder 1008 into an aft or actuation chamber 1040 and a forward or retraction chamber 1042. A seal 1043, such as a rubber O-ring, is preferably provided between the outer surface of the piston 1038 and the inner surface of the cylinder 1008. A return spring 1044 is engaged on the piston rod 1024 and enclosed within the cylinder 1008. The spring 1044 has an aft end attached to and/or biased against the retraction side 1041 of the piston 1038. A forward end of the spring 1044 is attached to and/or biased against the interior surface of the forward end of the cylinder 1008. The spring 1044 biases the piston 1038, piston rod 1024, and slider element 1022 toward the aft end of the mandrel 1002. In the illustrated embodiment, the spring 1044 comprises a coil spring. The number of coils and spring diameter is preferably chosen based on the required return loads and the space available. Those of ordinary skill in the art will understand that other types of springs or biasing means may be used.

Figure 16:
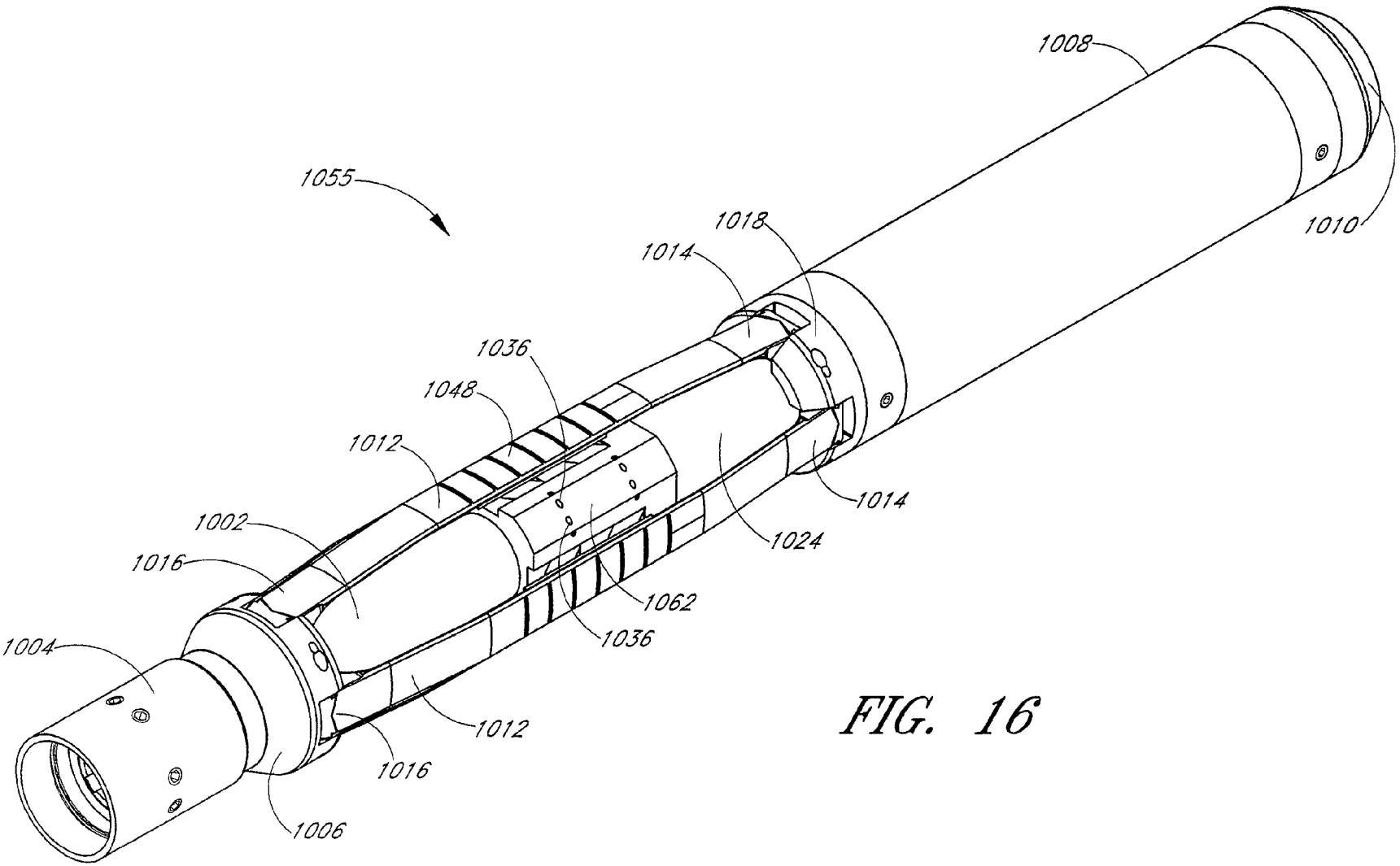
FIG. 16 is a perspective view of a gripper assembly having rollers secured to its slider element.
Figure 17:
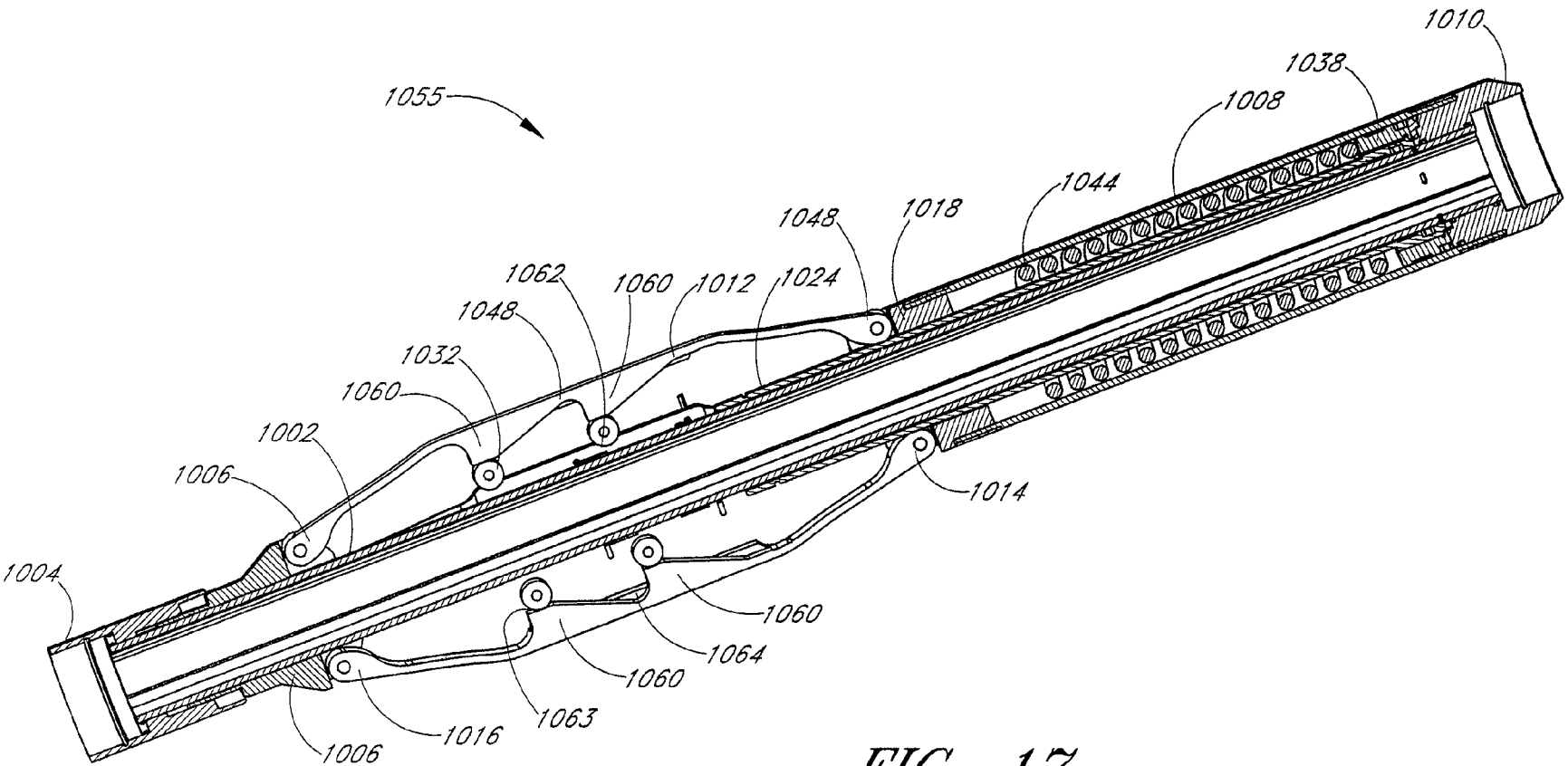
FIG. 17 is a longitudinal cross-sectional view of a gripper assembly having rollers secured to its slider element.

FIGS. 16 and 17 show a gripper assembly 1055 according to an alternative embodiment of the invention. In this embodiment, the rollers 1032 are located on a driver or slider element 1062. The toes 1012 include a driver interaction element that interacts with the driver to vary the radial position of the central sections 1048 of the toes. In the illustrated embodiment, the driver interaction element comprises one or more ramps 1060 on the interior surfaces of the central sections 1048. Each ramp 1060 slopes from a base 1064 to a tip 1063. The slider element 1062 includes external recesses sized to receive the tips 1063 of the ramps 1060. The roller axles 1036 extend transversely across these recesses, into holes in the sidewalls of the recesses. Preferably, the ends of the roller axles 1036 reside within one or more lubrication reservoirs in the slider element 1062. More preferably, such lubrication reservoirs are pressure-compensated by pressure compensation pistons, as described above in relation to the embodiments shown in FIGS. 12-15.

Although the gripper assembly 1055 shown in FIGS. 16 and 17 has four toes 1012, those of ordinary skill in the art will understand that any number of toes 1012 can be included. However, it is preferred to include three toes 1012, for more efficient and reliable contact with the inner surface of a passage or borehole. As in the previous embodiments, each toe 1012 may include any number of ramps 1060, although two are preferred. Desirably, there is at least one ramp 1060 per roller 1032.

The gripper assembly 1055 shown in FIGS. 16 and 17 operates similarly to the gripper assembly 1000 shown in the FIGS. 12-14. The actuation and retraction of the gripper assembly is controlled by the position of the piston 1038 inside the cylinder 1008. The fluid pressure in the actuation chamber 1040 controls the position of the piston 1038. Forward motion of the piston 1038 causes the slider element 1062 and the rollers 1032 to move forward as well. The rollers roll against the inclined surfaces or slopes of the ramps 1060, forcing the central regions 1048 of the toes 1012 radially outward.

Figure 18:
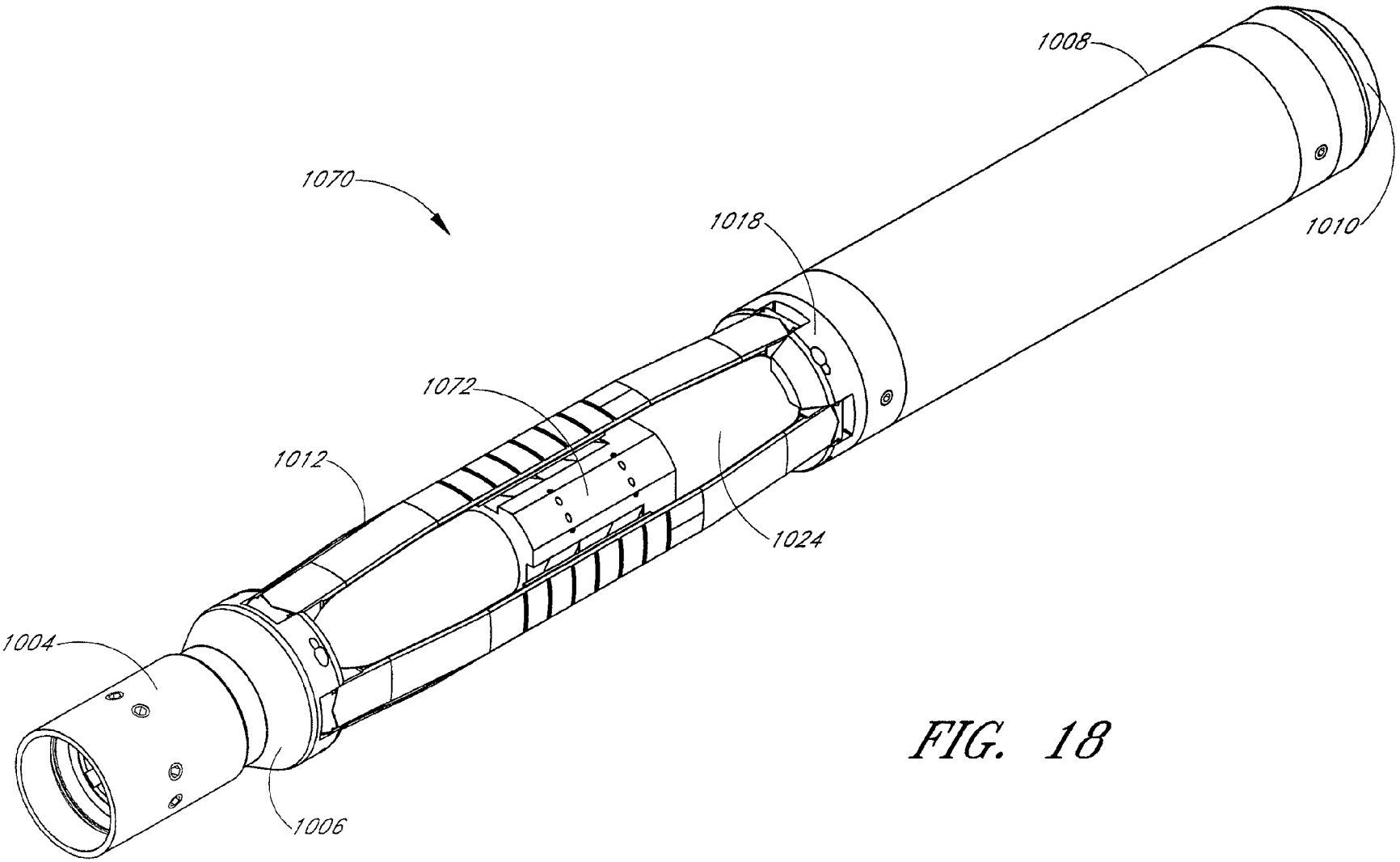
FIG. 18 is a perspective view of a retracted gripper assembly having toggles for causing radial displacement of the toes.
Figure 19:
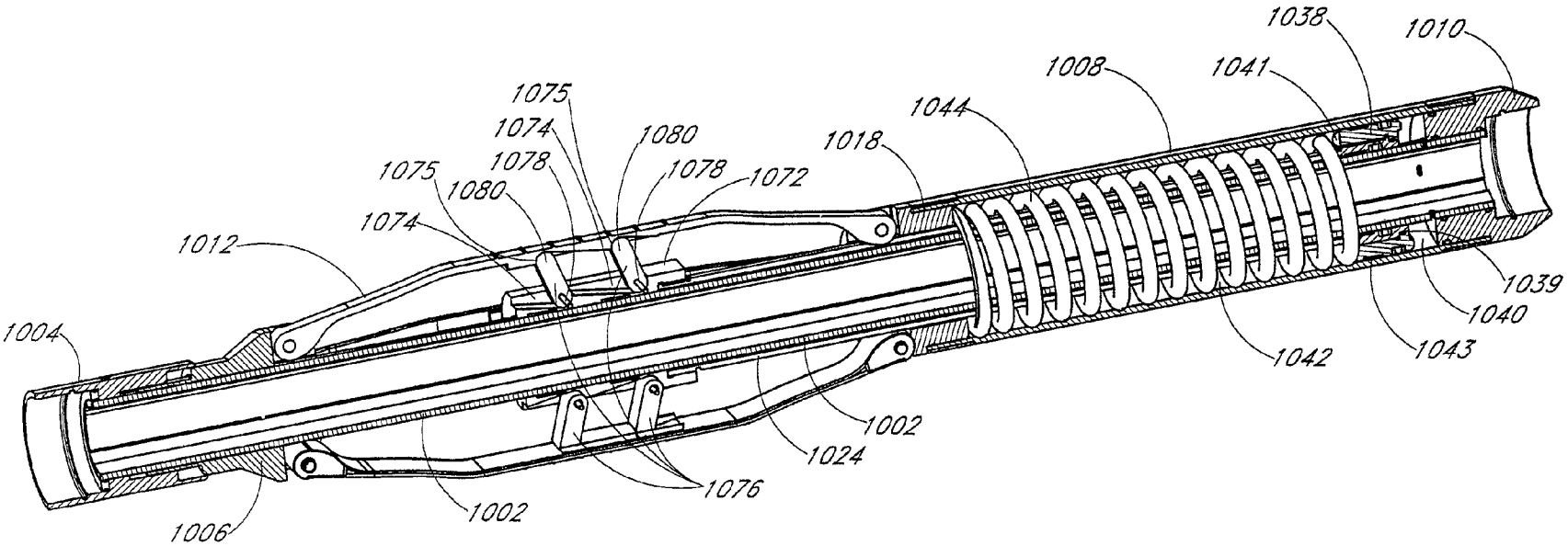
FIG. 19 is a longitudinal cross-sectional view of the gripper assembly of FIG. 18, shown in an actuated or gripping position.

FIGS. 18 and 19 show a gripper assembly 1070 having toggles 1076 for radially displacing the toes 1012. A slider element 1072 has toggle recesses 1074 configured to receive ends of the toggles 1076. Similarly, the toes 1012 include toggle recesses 1075 also configured to receive ends of the toggles. Each toggle 1076 has a first end 1078 received within a recess 1074 and rotatably maintained on the slider element 1072. Each toggle 1076 also has a second end 1080 received within a recess 1075 and rotatably maintained on one of the toes 1012. The ends 1078 and 1080 of the toggles 1076 can be pivotally secured to the slider element 1072 and the toes 1012, such as by dowel pins or hinges connected to the slider element 1062 and the toes 1012. Those of ordinary skill in the art will understand that the recesses 1074 and 1075 are not necessary. The purpose of the toggles 1076 is to rotate and thereby radially displace the toes 1012. This may be accomplished without recesses for the toggle ends, such as by pivoted connections of the ends.

In the illustrated embodiment, there are two toggles 1076 for each toe 1012. Those of ordinary skill in the art will understand that any number of toggles can be provided for each toe 1012. However, it is preferred to have two toggles having second ends 1080 generally at or near the ends of the central section 1048 of each toe 1012. This configuration results in a more linear shape of the central section 1048 when the gripper assembly 1070 is actuated to grip against a borehole surface. This results in more surface area of contact between the toe 1012 and the borehole, for better gripping and more efficient transmission of loads onto the borehole surface.

The gripper assembly 1070 operates similarly to the gripper assemblies 1000 and 1055 described above. The gripper assembly 1070 has an actuated position in which the toes 1012 are flexed radially outward, and a retracted position in which the toes 1012 are relaxed. In the retracted position, the toggles 1076 are oriented substantially parallel to the mandrel 1002, so that the second ends 1080 are relatively near the surface of the mandrel. As the piston 1038, piston rod 1024, and slider element 1072 move forward, the first ends 1078 of the toggles 1076 move forward as well. However, the second ends 1080 of the toggles are prevented from moving forward by the recesses 1075 on the toes 1012. Thus, as the slider element 1072 moves forward, the toggles 1076 rotate outward so that they are oriented diagonally or even nearly perpendicular to the mandrel 1002. As the toggles 1076 rotate, the second ends 1080 move radially outward, which causes radial displacement of the central sections 1048 of the toes 1012. This corresponds to the actuated position of the gripper assembly 1070. If the piston 1038 moves back toward the aft end of the mandrel 1002, the toggles 1076 rotate back to their original position, substantially parallel to the mandrel 1002.

Compared to the gripper assemblies 1000 and 1055 described above, the gripper assembly 1070 does not transmit significant radial loads onto the borehole surface when the toes 1012 are only slightly radially displaced. However, the gripper assembly 1070 comprises a significant improvement over the three-bar linkage gripper design of the prior art. The toes 1012 of the gripper assembly 1055 comprise continuous beams, as opposed to multi-bar linkages. Continuous beams have significantly greater torsional rigidity than multi-bar linkages, due to the absence of hinges, pin joints, or axles connecting different sections of the toe. Thus, the gripper assembly 1070 is much more resistant to undesired rotation or twisting when it is actuated and in contact with the borehole surface. Also, continuous beams involve few if any stress concentrations and thus tend to last longer than linkages. Another advantage of the gripper assembly 1070 over the multi-bar linkage design is that the toggles 1076 provide radial force at the central sections 1048 of the toes 1012. In contrast, the multi-bar linkage design involves moving together opposite ends of the linkage to force a central link radially outward against the borehole surface. Thus, the gripper assembly 1070 involves a more direct application of force at the central section 1048 of the toe 1012, which contacts the borehole surface. Another advantage of the gripper assembly 1070 is that it can be actuated and retracted substantially without any sliding friction.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Further, the various features of this invention can be used alone, or in combination with other features of this invention other than as expressly described above. Thus, it is intended that the scope of the present invention herein disclosed should not be limited by the particular disclosed embodiments described above, but should be determined only by a fair reading of the claims that follow.

What is claimed is:

1. A tractor for moving equipment through a borehole, comprising:

an elongate body having an internal passage extending longitudinally therethrough, the internal passage being adapted for receiving pressurized operating fluid from a supply line;

aft and forward gripper assemblies longitudinally movably engaged with the body, the aft and forward gripper assemblies each being hydraulically actuated and defining engagement surfaces configured to selectively engage an inner surface of the borehole;

aft and forward propulsion assemblies configured to advance the body through the borehole relative to the aft and forward gripper assemblies, respectively;

a valve system housed within the elongate body, the valve system being configured for directing a portion of the pressurized fluid from the internal passage to the aft and forward gripper assemblies in a desired sequence for effecting movement of the tractor through the borehole;

a tractor isolation apparatus configured to prevent fluid in the internal passage of the body from flowing into the valve system, to thereby prevent longitudinal movement of the body within the borehole; and a pressure relief valve that regulates the pressure of fluid that flows from the internal passage of the body to one or more components connected downhole of the tractor;

wherein when the isolation apparatus prevents fluid in the internal passage of the body from flowing into the valve system, the fluid in the internal passage can flow to the one or more components connected downhole of the tractor, the isolation apparatus comprising a start/stop valve having an open position in which the start/stop valve prevents fluid flow from the internal passage of the body into the valve system, the start/stop valve having a closed position in which the start/stop valve allows fluid flow from the internal passage into the valve system, the start/stop valve being configured to toggle between its open and closed positions when a differential fluid pressure between the internal passage of the body and an exterior of the tractor drops from a predefined high pressure threshold to a predefined low pressure threshold and then rises back to the high pressure threshold.

2. The tractor of claim 1, wherein the one or more components include a perforation gun assembly.

3. The tractor of claim 1, wherein the one or more components include an acidizing assembly.

4. The tractor of claim 1, wherein the one or more components include a sand-washing assembly.

5. The tractor of claim 1, wherein the one or more components include a bore plug setting assembly.

6. The tractor of claim 1, wherein the one or more components include an E-line.

7. The tractor of claim 1, wherein the one or more components include a logging assembly.

8. The tractor of claim 1, wherein the one or more components include a bore casing assembly.

9. The tractor of claim 1, wherein the one or more components include a measurement while drilling assembly.

10. The tractor of claim 1, wherein the one or more components include a fishing tool.

11. The tractor of claim 1, wherein the one or more components include a borehole drilling assembly.

12. A method of isolating a tool within a borehole, comprising:

providing an elongate body having an internal passage extending longitudinally therethrough;

providing aft and forward gripper assemblies longitudinally movably engaged with the body, the aft and forward gripper assemblies each being hydraulically actuated and defining engagement surfaces configured to selectively engage an inner surface of the borehole;

providing aft and forward propulsion assemblies configured to advance the body through the borehole relative to the aft and forward gripper assemblies, respectively;

connecting a supply line to the body;

positioning the body, the gripper assemblies, and the propulsion assemblies within the borehole;

conveying a fluid through the supply line into the internal passage of the body;

using a valve system housed within the elongate body to direct a portion of the pressurized fluid from the internal passage to the aft and forward gripper assemblies in a desired sequence for effecting movement of the body through the borehole;

after said using a valve system, preventing longitudinal movement of the body within the borehole by preventing the flow of fluid from the internal passage of the body to the valve system;

during said preventing longitudinal movement of the body, permitting fluid to flow from the internal passage of the body to one or more components connected downhole of the body; and using a pressure relief valve on the body to regulate the pressure of fluid that flows from the internal passage of the body to the components connected downhole of the tractor;

wherein said preventing the flow of fluid from the internal passage of the body to the valve system comprises moving a start/stop valve to a closed position;

wherein the start/stop valve has an open position in which the start/stop valve permits fluid flow from the internal passage of the body into the valve system, the start/stop valve in its closed position preventing fluid flow from the internal passage into the valve system, the method further comprising toggling the start/stop valve between its open and closed positions by varying a differential fluid pressure between the internal passage of the body and an exterior of the body from a predefined high pressure threshold to a predefined low pressure threshold and then back to the high pressure threshold.

* * * * *